US009944493B2

(12) United States Patent
Dudde et al.

(10) Patent No.: US 9,944,493 B2
(45) Date of Patent: Apr. 17, 2018

(54) ELEVATOR SUSPENSION AND TRANSMISSION STRIP

(75) Inventors: Frank P. Dudde, Collierville, TN (US); Peter P. Feldhusen, Collierville, TN (US); Gomaa G. Abdelsadek, San Diego, CA (US); Alan M. Parker, Byhalia, MS (US); Jie Xu, Cordova, TN (US); Stephen D. Allen, Middleton, TN (US); Mike Palazzola, Horn Lake, MS (US)

(73) Assignee: ThyssenKrupp Elevator AG, Essen (DE)

( * ) Notice: Subject to any disclaimer, the term of this patent is extended or adjusted under 35 U.S.C. 154(b) by 429 days.

(21) Appl. No.: 13/092,391

(22) Filed: Apr. 22, 2011

(65) Prior Publication Data

US 2011/0259677 A1 Oct. 27, 2011

Related U.S. Application Data

(60) Provisional application No. 61/326,918, filed on Apr. 22, 2010, provisional application No. 61/368,050,
(Continued)

(51) Int. Cl.
*B66B 7/00* (2006.01)
*B66B 7/06* (2006.01)
(Continued)

(52) U.S. Cl.
CPC ..... *B66B 7/062* (2013.01); *D07B 1/145* (2013.01); *D07B 1/148* (2013.01); *D07B 5/006* (2015.07);
(Continued)

(58) Field of Classification Search
None
See application file for complete search history.

(56) References Cited

U.S. PATENT DOCUMENTS 2,237,173 A * 4/1941 Brill ..... 428/126
2,766,159 A * 10/1956 Adams, Jr. et al. ..... 198/847
(Continued)

FOREIGN PATENT DOCUMENTS

DE 38 13 338 11/1989
DE 3813338 * 11/1989
(Continued)

OTHER PUBLICATIONS

Chemistry of Materials, vol. 22 No. 8, pp. 2616-2625, "Thiol-Isocyanate-Ene Ternary Netwroks by Sequential and Simultaneous Thiol Click Reactions", Junghwan Shin, Hironori Matsushima, Christopher M. Comer, Christopher N. Bowman, and Charles E. Hoyle.*
(Continued)

*Primary Examiner* — Shawn Mckinnon
*Assistant Examiner* — LaShawnda T. Mckinnon
(74) *Attorney, Agent, or Firm* — Frost Brown Todd LLC

(57) ABSTRACT

A suspension and transmission device for use with an elevator system comprises one or more strips that provide load carrying, transmission or traction, and load carrying redundancy or safety functions for the elevator system. In one version a single strip comprised of polymer and composite materials provides these functions. In another version multiple strips comprised of polymer and composite materials provide these functions. In another version, a strip comprises a hollow interior portion. In another version one or more strips incorporate materials that can be detected when using the strip to monitor the condition of the one or more strips.

9 Claims, 11 Drawing Sheets

Related U.S. Application Data filed on Jul. 27, 2010, provisional application No. 61/421,035, filed on Dec. 8, 2010.

(51) Int. Cl.

| | |
|---|---|
| ***D07B 5/00*** | (2006.01) |
| ***D07B 1/14*** | (2006.01) |
| *D07B 1/16* | (2006.01) |
| *D07B 1/22* | (2006.01) |

(52) U.S. Cl.

CPC ..... *D07B 1/16* (2013.01); *D07B 1/22* (2013.01); *D07B 2201/1004* (2013.01); *D07B 2205/205* (2013.01); *D07B 2205/2014* (2013.01); *D07B 2205/2042* (2013.01); *D07B 2205/2096* (2013.01); *D07B 2205/301* (2013.01); *D07B 2205/3003* (2013.01); *D07B 2205/3007* (2013.01); *D07B 2205/3017* (2013.01); *D07B 2205/3082* (2013.01); *D07B 2301/555* (2013.01); *D07B 2301/5563* (2013.01); *D07B 2501/2007* (2013.01)

(56) References Cited

U.S. PATENT DOCUMENTS

| | | | | |
|---|---|---|---|---|
| 2,916,136 | A * | 12/1959 | Combs | B29D 29/06 156/221 |
| 4,092,818 | A * | 6/1978 | Brewster | A01F 15/07 100/5 |
| 4,745,023 | A * | 5/1988 | Chapman et al. | 442/183 |
| 4,799,584 | A * | 1/1989 | Hartsuiker et al. | 198/709 |
| 5,320,471 | A * | 6/1994 | Grathoff | 414/140.9 |
| 5,326,411 | A * | 7/1994 | Arnold | A01F 15/07 156/137 |
| 5,358,976 | A * | 10/1994 | Dowling et al. | 522/18 |
| 5,608,115 | A | 3/1997 | Okazaki et al. | |
| 6,232,426 | B1 * | 5/2001 | Orikabe et al. | 528/91 |
| 6,397,974 | B1 | 6/2002 | Adifon et al. | |
| 6,401,871 | B2 | 6/2002 | Baranda et al. | |
| 6,672,046 | B1 | 1/2004 | Prewo et al. | |
| 6,739,433 | B1 | 5/2004 | Baranda et al. | |
| 6,983,826 | B2 * | 1/2006 | Wake et al. | 187/252 |
| 7,040,456 | B2 | 5/2006 | Ach et al. | |
| 7,117,981 | B2 | 10/2006 | Logan et al. | |
| 7,326,139 | B2 | 2/2008 | Eichhorn et al. | |
| 8,157,058 | B2 | 4/2012 | Ach | |
| 8,181,312 | B2 | 5/2012 | Attinger et al. | |
| 8,210,321 | B2 | 7/2012 | Finschi et al. | |
| 2001/0045326 | A1 | 11/2001 | Gottlieb et al. | |
| 2002/0092285 | A1 | 7/2002 | Aulanko et al. | |
| 2002/0097833 | A1 * | 7/2002 | Kaiser et al. | 378/45 |
| 2003/0024770 | A1 | 2/2003 | O'donnell et al. | |
| 2003/0062225 | A1 * | 4/2003 | Stucky et al. | 187/393 |
| 2007/0102245 | A1 | 5/2007 | Shibasaki et al. | |
| 2008/0087500 | A1 | 4/2008 | Ach et al. | |
| 2010/0044158 | A1 | 2/2010 | Göser | |
| 2010/0133046 | A1 * | 6/2010 | Allwardt et al. | 187/251 |

FOREIGN PATENT DOCUMENTS

| | | | |
|---|---|---|---|
| FR | 2636392 | * | 3/1990 |
| GB | 2458001 A | | 9/2009 |
| TW | 467941 B | | 12/2001 |
| WO | WO 2003/059798 | | 7/2003 |
| WO | 2007/144451 | | 12/2007 |
| WO | WO2008110241 | * | 9/2008 |
| WO | WO 2009/090299 | * | 7/2009 |

OTHER PUBLICATIONS

Oxford Online Dictionary (OED Online. Mar. 2013, Oxford Univeristy Press, May 24, 2013, http://www.oed.com/view/Entry/35817.*

Machine translation of JP2006153027 Igawa et al.*

Annex to Form PCT/ISA/206 Communication Relating to the Results of the Partial International Search dated Aug. 26, 2011 for Application No. PCT/US2011/033593.

International Search Report and Written Opinion dated Jan. 2, 2012 for Application No. PCT/US2011/33593.

International Preliminary Report on Patentability dated Oct. 23, 2012 for Application No. PCT/US2011/33593.

Canadian Office Action dated May 13, 2014 for Application No. CA 2,797,020.

Chinese Office Action dated May 30, 2014 for Application No. CN 201180030921.7.

Korean Office Action dated Nov. 6, 2013 for Application No. KR 10-212-70304.

* cited by examiner

ELEVATOR SUSPENSION AND TRANSMISSION STRIP

PRIORITY

This application claims priority to: U.S. Provisional Patent Application Ser. No. 61/326,918, filed Apr. 22, 2010, entitled "Suspension-Transmission Strip System and Method;" U.S. Provisional Patent Application Ser. No. 61/368,050, filed Jul. 27, 2010, entitled "Suspension-Transmission Strip System and Method;" and U.S. Provisional Patent Application Ser. No. 61/421,035, filed Dec. 8, 2010, entitled "Suspension-Transmission Strip System and Method," the disclosures of which are incorporated by reference herein.

BACKGROUND

With some elevator systems one or more steel cables function as suspension and transmission structures that work in conjunction with other equipment to raise and lower an elevator. Described herein are versions of strips for use with an elevator system where the strips function as suspension and transmission structures that work in conjunction with other equipment to raise and lower an elevator. In some examples these one or more strips replace one or more steel cables entirely.

While a variety of equipment and systems for raising and lowering an elevator have been made and used, it is believed that no one prior to the inventor(s) has made or used an invention as described herein.

BRIEF DESCRIPTION OF THE DRAWINGS

While the specification concludes with claims that particularly point out and distinctly claim the invention, it is believed the present invention will be better understood from the following description of certain examples taken in conjunction with the accompanying drawings. In the drawings like reference numerals identify the same elements. Hatching in sections views has been omitted where such hatching would detract from the legibility of the drawing. Hatching that is included only provides indication of sectioned portions generally, and the materials of construction for the object shown are not required to be, or limited to, any material type conveyed by the style of hatching used.

Figure 1:
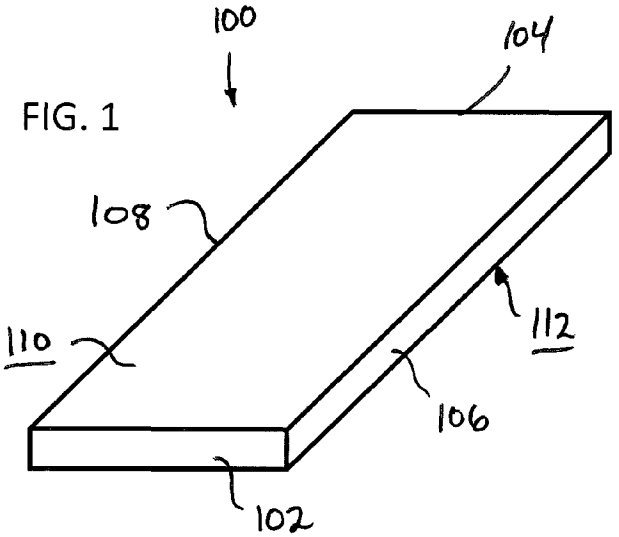
FIG. 1 depicts a perspective view of an exemplary strip for use with an elevator.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. For example, those of ordinary skill in the art will realize that there are a number of techniques that can be used in designing an exemplary strip for use with an elevator. Many of these techniques are described herein, and still others will be apparent to those of ordinary skill in the art based on the teachings herein. The teachings herein with regard to these techniques can be applied to any number of exemplary strips, and not solely the exemplary strip discussed in the context of the technique being described. Furthermore any number of these techniques can be combined in designing a strip. Accordingly, the drawings and descriptions should be regarded as illustrative in nature and not limiting.

After a brief discussion of some functional considerations and features regarding strips for use with an elevator, subsequent sections describe exemplary constructions for such strips, exemplary arrangements for such strips, and exemplary materials of construction for such strips. Following that are additional sections describing some exemplary strips and some exemplary techniques for monitoring strips in use.

I. Functional Considerations and Features

Some strips for use with an elevator system described herein are designed to provide sufficient functionality in terms of load carrying, safety, and transmission. Load carrying pertains to the strips having sufficient strength and durability to support an elevator in use. Safety pertains to the one or more strips having sufficient redundancy in the load carrying function such that the one or more strips can carry the load of the elevator if a failure occurs in the structure or structures that provide the primary load support. Transmission pertains to the one or more strips having sufficient friction with a driven member, such as a traction sheave, to avoid undesired slippage between the one or more strips and driven member. Some features of a strip for consideration include having sufficient binding of the components that comprise the strip, and also providing sufficient protection of the strip during assembly, handling, and use. This list and brief description of functional considerations and features is not exhaustive, and the sections that follow will elaborate on these and other functional considerations and features where appropriate.

II. Strip Construction

Figure 2:
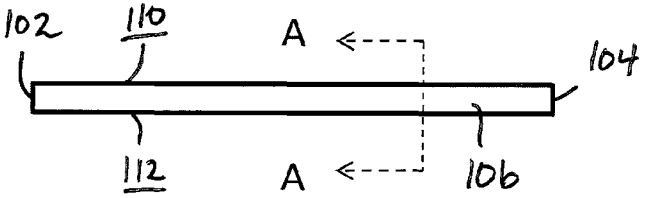
FIG. 2 depicts a side view of the strip of FIG. 1 from the longitudinal direction.
Figure 3:
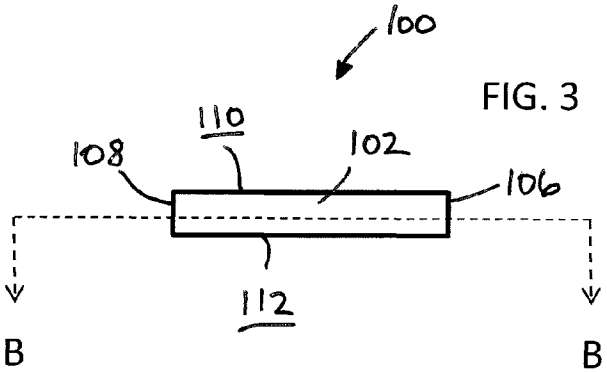
FIG. 3 depicts an end view of the strip of FIG. 1 from the transverse direction.

FIGS. 1-3 illustrate an exemplary strip (100) for use with an elevator. Strip (100) comprises a first end (102), second end (104), first side (106), second side (108), first surface (110), and second surface (112). Strip (100) has a length extending in a longitudinal direction defined by the distance between first and second ends (102, 104), a width extending in a transverse direction defined by the distance between first and second sides (106, 108), and a thickness defined by the distance between first and second surfaces (110, 112). Several sectional views of strips similar to strip (100) are shown and described below. With the exception of differences noted and discussed, generally, the description of strip (100), as it pertains to FIGS. 1-3, applies equally to other strips described as similar to strip (100).

A. Layers and Components

In describing exemplary constructions for various strip examples, several section views are shown and described. The section views represent different versions of strips similar to strip (100). The teachings with regard to the section views are not intended to be mutually exclusive; thus, teachings with respect to one section view can be combined with the teachings from one or more other section views.

Strip (100) and other strips similar thereto can be considered to be constructed of one or more components. These components can be positioned such that the strips can be single layer strips in some versions or multiple layer strips in other versions. Furthermore, each layer of the strips can be comprised of one or more components as described further below. The functions and features described above, e.g. load carrying, safety, and transmission, can be provided by single components, combinations of components, single layers, or combinations of layers.

Figure 4:
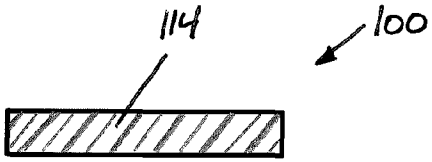
FIG. 4 depicts a section view of the strip of FIG. 1 taken from the longitudinal direction along the line A-A of FIG. 2, where the strip comprises a single layer having a single component.
Figure 5:
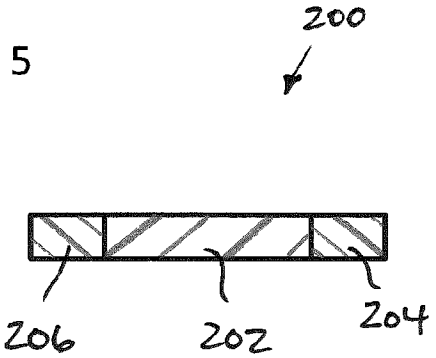
FIG. 5 depicts a section view taken from the longitudinal direction in another version of a strip similar to the strip of FIG. 1, where the strip comprises a single layer having multiple components positioned side-by-side.

FIGS. 4 and 5 illustrate strips that comprise a single layer. In the illustrated version in FIG. 4, strip (100) comprises a single component (114). In the illustrated version in FIG. 5, strip (200) comprises multiple components (202, 204, 206) positioned side-by-side. While strip (200) comprises three components positioned side-by-side, fewer or more components can be used in other versions. By way of example only, in one version single layer, single component strip (100) is configured to provide functions of load carrying, safety, and transmission all in a single strip (100). In other versions, multiple strips (100) are used to provide these functions or combinations of these functions.

Figure 6:
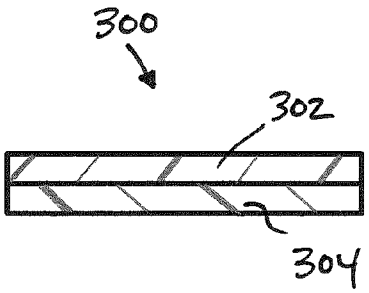
FIG. 6 depicts a section view taken from the longitudinal direction in another version of a strip similar to the strip of FIG. 1, where the strip comprises multiple layers having multiple components positioned one above the other.
Figure 7:
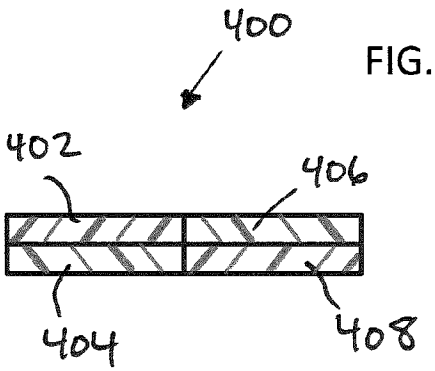
FIG. 7 depicts a section view taken from the longitudinal direction in another version of a strip similar to the strip of FIG. 1, where the strip comprises multiple layers having multiple components positioned side-by-side and one above the other.

FIGS. 6 and 7 illustrate strips that comprise multiple layers. In the illustrated version in FIG. 6, strip (300) is a multiple layer strip that comprises multiple components (302, 304) that are positioned one above the other. In the illustrated version in FIG. 7, strip (400) is a multiple layer strip that comprises multiple components (402, 404, 406, 408) that are positioned side-by-side and one above the other. While strip (300) shown in FIG. 6 comprises two components positioned one above the other, more than two components can be used in other versions. Similarly, while strip (400) shown in FIG. 7 comprises two components positioned one above the other and positioned side-by-side with two components also positioned one above the other, more than two components can be used in other versions. By way of example only, in one version of strip (300), the layer comprised of component (304) is configured to provide the transmission and load carrying functions, while the layer comprised of component (302) is configured to provide the safety function. In other versions, multiple strips (300) are used to provide these functions or combinations of these functions.

Figure 8:
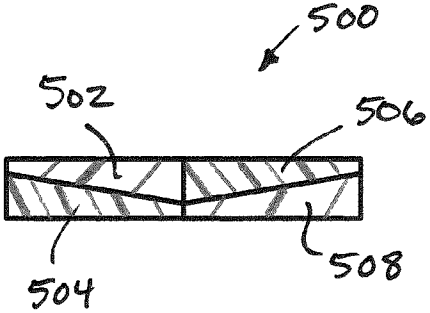
FIG. 8 depicts a section view taken from the longitudinal direction in another version of a strip similar to the strip of FIG. 1, where the strip comprises multiple layers having components positioned side-by-side and one above the other, where the components have varying thicknesses across their width.

FIG. 8 illustrates strip (500) that is a multiple layer strip similar to that shown in FIG. 7. However in FIG. 8, components (502, 504) are positioned one above the other and have a variable thickness across their widths. Yet when components (502, 504) are combined, they have a uniform thickness. This is the same for components (506, 508). Furthermore, in the present example, components positioned side by side are mirror images of one another in terms of thicknesses across their respective widths. While combining components (502, 504, 506, 508) in the present example produces strip (500) having a uniform thickness, in other versions components can have variable thicknesses across their widths such that standing alone, or in combination with other components, resultant strip (500) can have a non-uniform thickness across its width. By way of example only, and not limitation, in some versions the thickness of strip (500) can be greater at the edges. Still yet in other versions the thickness of strip (500) can be greater in the middle.

Figure 9:
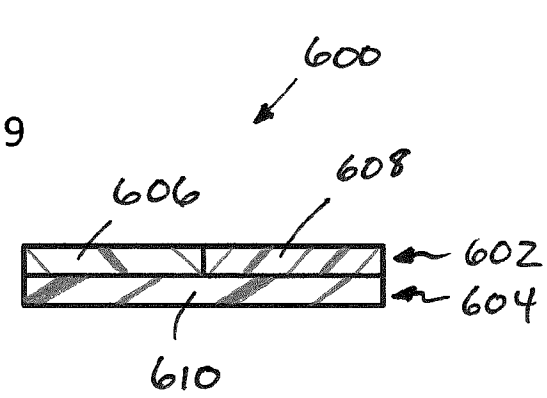
FIG. 9 depicts a section view taken from the longitudinal direction in another version of a strip similar to the strip of FIG. 1, where the strip comprises multiple layers having an unequal number of components in each layer.

FIG. 9 illustrates strip (600) that is a multiple layer strip similar to that shown in FIG. 7. However in FIG. 9, the layers have unequal numbers of components, with top layer (602) having two components (606, 608) and bottom layer (604) having one component (610). As shown in the present example, the widths of layers (602, 604) are equal; however, in other versions the widths of layers (602, 604) are unequal. Also as shown in the present example of FIG. 9, strip (600) comprises two layers in total; however, any number of layers can be used in other versions.

Figure 11:
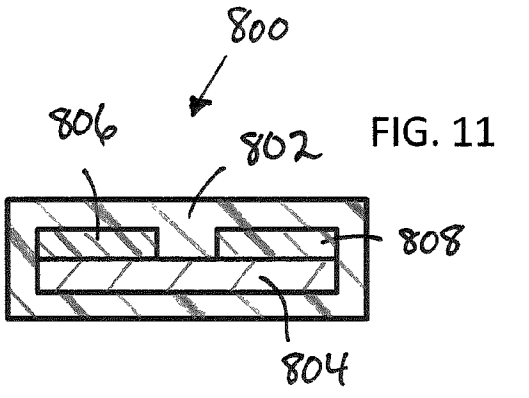
FIG. 11 depicts a section view taken from the longitudinal direction in another version of a strip similar to the strip of FIG. 1, where the strip comprises multiple layers created by multiple components being surrounded by a jacket component.
Figure 10:
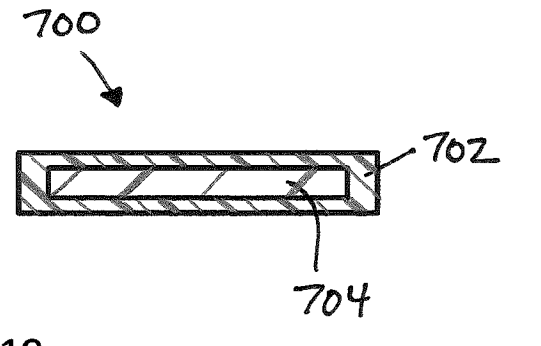
FIG. 10 depicts a section view taken from the longitudinal direction in another version of a strip similar to the strip of FIG. 1, where the strip comprises multiple layers created by one component being surrounded by a jacket component.

FIG. 10 illustrates strip (700) where a multiple layer strip is created by jacket component (702) surrounding component (704). Similarly, FIG. 11 illustrates strip (800) where jacket component (802) surrounds multiple components (804, 806, 808). As shown in FIG. 11, one or more components (806, 808) of strip (800) are spaced apart and jacket component (802) surrounds components (804, 806, 808) filling-in the spaces between components (806, 808). Still in other versions, jacket component (802) can act like a sleeve surrounding the spaced apart multiple components (806, 808) collectively such that jacket component (802) does not fill-in the spaces between components (806, 808). In some contexts, jacket component (702, 802) can be thought of, or used interchangeably with the terms envelope, sleeve, and sheath. By way of example only, in one version of strip (700), the outer portion comprised of component (702) is configured to provide the transmission function, while the inner portion comprised of component (704) is configured to provide the load carrying and safety functions. In other versions, multiple strips (700) are used to provide these functions or combinations of these functions, or strip (700) is used with strips of other versions to provide these functions, e.g. using strip (700) for transmission and load carrying with strip (100) for safety.

Figure 12:
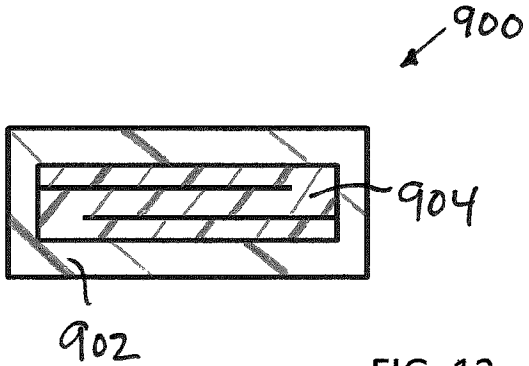
FIG. 12 depicts a section view taken from the longitudinal direction in another version of a strip similar to the strip of FIG. 1, where the strip comprises multiple layers created by one or more longitudinal folds that are surrounded by a jacket component, where the folds are laid one on top of another.
Figure 13:
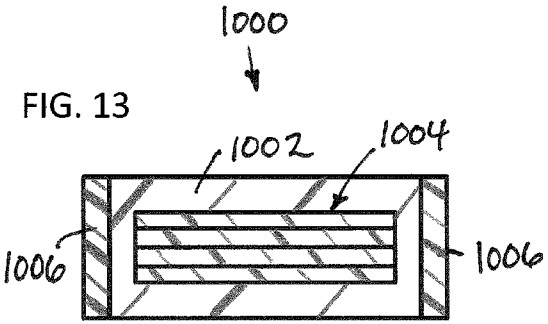
FIG. 13 depicts a section view taken from the longitudinal direction in another version of a strip similar to the strip of FIG. 1, where the strip comprises multiple layers created by one or more transverse folds that are surrounded by a jacket component.

FIGS. 12 and 13 illustrate strips where a multiple layer strip is created in part by components having longitudinal or transverse folds. In FIG. 12, component (904) is folded back and forth in the longitudinal direction creating multiple layers. These folded layers are then surrounded by jacket component (902). In FIG. 13, component (1004) is folded back and forth in the transverse direction to create an area of multiple layers. These folded layers are then surrounded by jacket component (1002). While the versions shown in FIGS. 12 and 13 show components (904, 1004) folded tightly such that successive layers of component (904, 1004) appear touching, this configuration is not required. In some other versions, components (904, 1004) can be folded, either in the longitudinal and/or transverse directions, such that space remains between the folds. In such versions other components or jacket components can fill-in the space between the folds. By way of example only, and not limitation, in some versions multiple components can be layered and then folded, either in the longitudinal and/or transverse directions, to create further layering. The folded areas of strips (900, 1000) shown in FIGS. 12 and 13 can be for the entire strip (900, 1000) or for only one or more portions of strip (900, 1000).

Figure 15:
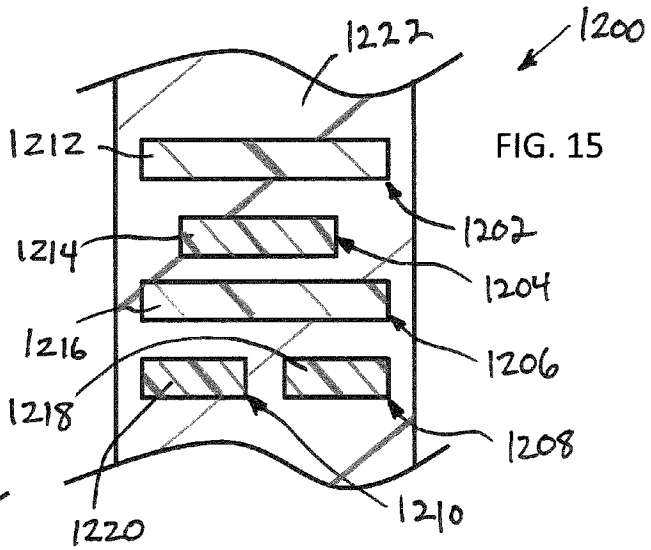
FIG. 15 depicts a section view taken from the transverse direction in another version of a strip similar to the strip of FIG. 1, where the strip comprises transverse pockets.
Figure 14:
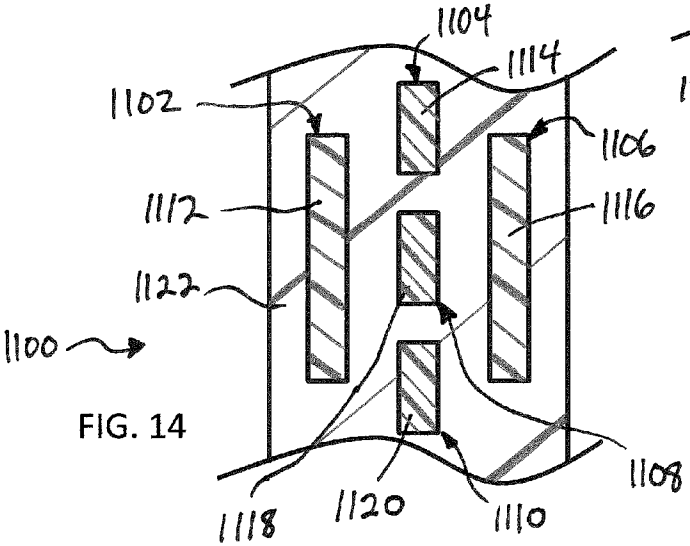
FIG. 14 depicts a section view taken from the transverse direction along the line B-B of FIG. 3, where the strip comprises longitudinal pockets.

FIGS. 14 and 15 illustrate strips where a multiple layer strip is created by having one or more pockets that extend in the longitudinal direction, as shown in FIG. 14, or that extend in the transverse direction, as shown in FIG. 15. In the illustrated version in FIG. 14, pockets (1102, 1104, 1106, 1108, 1110) contain components (1112, 1114, 1116, 1118, 1120). Furthermore, pockets (1102, 1104, 1106, 1108, 1110) and components (1112, 1114, 1116, 1118, 1120) are surrounded by jacket component (1122). In the illustrated version of FIG. 15, pockets (1202, 1204, 1206, 1208, 1210) contain components (1212, 1214, 1216, 1218, 1220). Furthermore, pockets (1202, 1204, 1206, 1208, 1210) and components (1212, 1214, 1216, 1218, 1220) are surrounded by jacket component (1222). In other versions, strips (1100, 1200) can have multiple pockets containing components where the pockets extend in both longitudinal and transverse directions. In the illustrated versions in FIGS. 13 and 14, pockets (1102, 1104, 1106, 1108, 1110, 1202, 1204, 1206, 1208, 1210) are shown as discontinuous over the length and width of strips (1100, 1200). In other versions, pockets can be continuous over the length or width of the strips.

B. Surfaces and Edges

In some versions of strips that are multiple layers, the surfaces of one or more components can be configured with certain topography to provide desired inter-layer or inter-component properties. For example, in some versions one or more components include micro-teeth. These micro-teeth of one component engage the surface of another component, and/or increase the friction between component surfaces. This action can be useful for controlling the displacement between components. In some versions components can be configured such that the components collectively incorporate a hook and loop type of design. In these versions, a hook feature of one component is configured to engage with a corresponding loop feature of another component. Still in other versions, a desired topography for one or more components can include more gradual surface features such as ridges or other undulations on the surface of components. In contrast to a flat surface, components having micro-teeth, hook and loop, ridges, or other similar features on their surface, can—at least in some versions—provide an increase in the surface area contact between adjacent components.

One approach to imparting a desired topography to the surfaces of one or more components can be by dispersing small particles of high stiffness material within a given component. These particles, some of which will be located on the surfaces of components, function as micro-teeth in some versions as described above. Still another approach to imparting a desired topography to the surfaces of one or more components can include embossing components or forming components with a pattern, e.g. by weaving fibers together to create a desired topography or surface texture.

Referring again to FIG. 13, strip (1000) comprises edge components (1006) as shown. Edge components (1006) extend longitudinally along the first side and second side of strip (1000). Edge components (1006) can serve a variety of functions that can include protecting strip (1000) from damage during operation and/or assembly. In some versions, edge components (1006) seal the first side and second side of strip (1000). Still in some versions edge components (1006) can serve to provide enhanced transmission characteristics between strip (1000) and a traction sheave or roller.

C. Surface Transmission Patterns

Referring to FIG. 1 again, first surface (110) and/or second surface (112) can be designed as the surface of strip (100) that will contact a traction sheave in some elevator designs. This surface is sometimes referred to as the engagement surface. The texture of the engagement surface can be a factor in the transmission function of a strip. Traction efficiency is a way to consider the transmission function, where an increase in traction efficiency means an improvement in the transmission function of the strip. In some versions a pattern is imparted to the engagement surface increasing the overall roughness of the engagement surface such that the friction between the engagement surface and the traction sheave is increased, thereby increasing the traction efficiency.

In some versions the traction sheave can be formed with a pattern to further improve the traction efficiency of the system. The patterns used on the engagement surface and on the traction sheave can be complementary patterns, where the patterns engage in an interlocking fashion; of course complementary patterns are not required in all versions. In some versions where the traction sheave includes a pattern designed for use with a patterned engagement surface, the compressive forces on the strip, when engaged with the traction sheave, can be reduced by the three-dimensional nature of the patterns providing more contact surface area between the strip and the traction sheave, thereby distributing the compression forces over a greater surface area.

Figure 16:
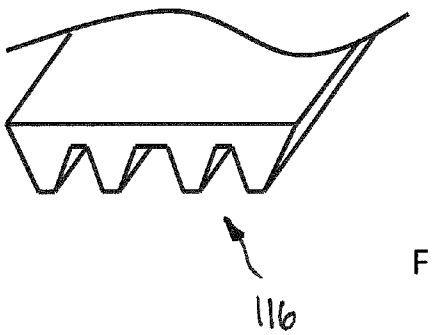
FIG. 16 depicts a perspective view shown in section of an engagement surface of an exemplary strip, with the engagement surface having an angular transmission pattern.
Figure 17:
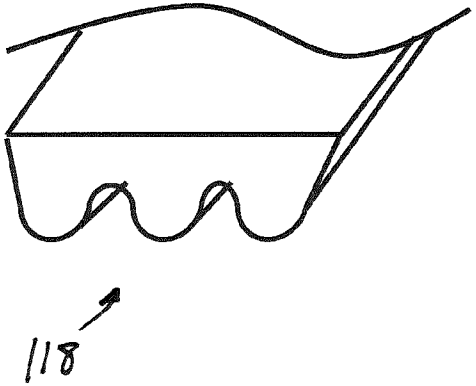
FIG. 17 depicts a perspective view shown in section of an engagement surface of an exemplary strip, with the engagement surface having a curved transmission pattern.

The textures of the engagement surface can be classified according to pattern and direction, where direction refers to the direction the pattern extends relative to the length and width of a strip. By way of example only, the pattern of the engagement surface can be flat, curved, angular, or a mix of curved and angular. FIGS. 16-17 show examples of patterned engagement surfaces (116, 118) that can be incorporated into a variety of strips. The engagement surface patterns are angular as in FIG. 16 and curved as in FIG. 17. Of course a combination or mix of angular and curved patterns can be used in other versions.

The direction the pattern extends can be longitudinal, transverse, or a mix of these, e.g. diagonal. The patterns can further extend varying degrees. For instance in some versions the patterns can extend longitudinally the entire length of a strip. In other versions the patterns can extend transversely the entire width of a strip. In other versions, the patterns can extend for only a portion of the length or width of a strip. For example, the patterns can extend in a discontinuous fashion to produce an engagement surface with spaced patterned regions. The exemplary patterns shown and described above are not exhaustive. Other patterns and/or directions that can be used include a sawtooth pattern, an orb pattern, a pyramid pattern, a quadrangular pattern, a diagonal rhomboid pattern, among others.

III. Strip Arrangements

Figure 18:
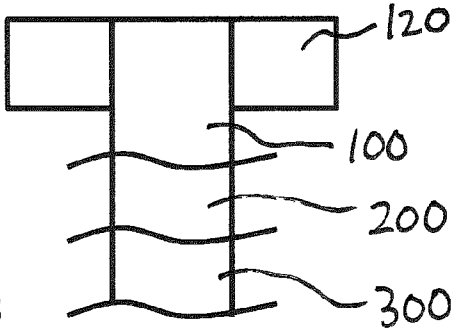
FIG. 18 depicts a front view of an exemplary arrangement of strips for use with an elevator, where the strips have a stacked arrangement.

FIG. 18 illustrates a stacked arrangement for multiple strips (100, 200, 300). In this stacked arrangement, multiple strips (100, 200, 300) are positioned over one another and configured to run over a traction sheave (120). In other drum elevator examples, the multiple stacked strips (100, 200, 300) are positioned over one another and configured to be wound and unwound around a drum. In the illustrated version in FIG. 18, three strips (100, 200, 300) accomplish the functions of the elevator system, e.g. load carrying, safety, and transmission. In other versions greater or fewer strips can be used in the stacked arrangement to accomplish the functions of the elevator system.

Figure 19:
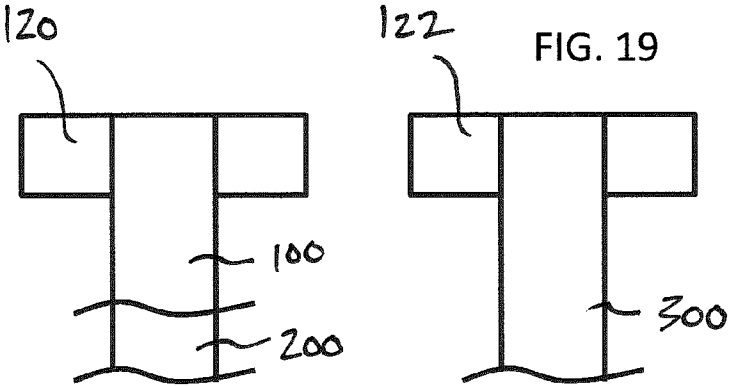
FIG. 19 depicts an front view of an exemplary arrangement of strips for use with an elevator, where the strips have a series arrangement.

FIG. 19 illustrates a series arrangement for multiple strips (100, 200, 300). In this series arrangement, multiple strips (100, 200, 300) are positioned side-by-side or spaced at some interval. In some versions, the spaced strips (100, 200, 300) can run over the same traction sheave. In some other versions, the spaced strips (100, 200, 300) run over more than one traction sheave or roller. As shown in the illustrated version of FIG. 19, two strips (100, 200) run over traction sheave (120) while a third strip (300) runs over a separate roller (122). In the present example, strips (100, 200) serve the load carrying and transmission functions while strip (300) serves the safety function. In other versions, greater or fewer strips can be used in the series arrangement to serve the load, transmission, and safety functions. In other drum elevator examples, the multiple strips (100, 200, 300) are positioned side-by-side or spaced at some interval and configured to be wound and unwound around one or more drums.

While FIGS. 18 and 19 generally show exemplary stacked and series arrangements for one or more strips, in other versions other systems can be present, e.g. gear sections, and the one or more strips can be configured to run through those systems as well. Furthermore, in some versions with multiple strips, the strips can track through the system, thereby running in the stacked arrangement at some points and running in the series arrangements at other points.

IV. Materials

As discussed above, strips are comprised of one or more components, and can also include one more jacket components and/or one or more edge components. Components, jacket components, and edge components can be comprised of a variety of materials. Material selection is driven by the desired properties for a particular component, which is in turn driven by the desired function(s) and/or feature(s) for the component and strip. A non-exhaustive list of properties for consideration when making material selections include: stiffness, tensile strength, weight, durability, compatibility with other materials (e.g. ability for glass-fiber or other fiber reinforcement), heat resistance, chemical resistance, flame resistance, dimensional stability, surface friction, vibration absorption, among others.

As mentioned previously, the functional considerations and features related to these and other properties can include load carrying, safety, transmission, binding, and protection.

The following paragraphs describe several categories of materials and specific material examples. While some of these materials may be discussed in the context of one or more functional considerations and/or features, the materials can have application relative to other functional considerations and/or features. Also, the materials discussion refers to components generally, and it is intended that the discussion of materials applies equally to all components that can be used in constructing one or more strips as described herein. So, for example, any of the components described above can be comprised of any of the material options described below.

Strips can be comprised of materials that include fibers, polymers, composites of fibers and polymers, and additives. The following sections will describe these materials in greater detail.

A. Fibers and Fabrics

Fiber is one category of material that can be used to deliver strength to a strip, and fiber can serve the load carrying and safety functions. Fiber can be continuous filaments or discrete elongated pieces, similar to lengths of thread. Fiber can be natural (e.g. cotton, hair, fur, silk, wool) or manufactured (e.g. regenerated fibers and synthetic fibers). Fiber can be formed into fabrics in numerous ways and having various patterns as described more below. Fiber can be combined with plastic resin and wound or molded to form composite materials (e.g. fiber reinforced plastic) as described more below. Fiber can also be mineral fiber (e.g. fiberglass, metallic, carbon), or polymer fibers based on synthetic chemicals. By way of example only, and not limitation, fiber can be made from: carbon (e.g. AS-4 PAN-based carbon, IM-7 PAN-based carbon, P120 pitch-based graphite, carbon nanotube, carbon nanotube composites); aramid (e.g. Kevlar, Twaron, Nomex, Technora); graphite; glass; ceramic; tungsten; quartz; boron; basalt; zirconia; silicon carbide; aluminum oxide; steel; ultra-high molecular weight polyethylene (e.g. Dyneema); liquid crystal polymer (e.g. Vectran); poly p-phenylene-2,6-benzobisoxazole (PBO) (e.g. Zylon); preimpregnated fiber fabric with epoxies, thiol-cured epoxy, amine-cured epoxy, phenolics, bismaleimides, cyanate esters, polyester, thermoplastic polyester elastomer, nylon resin, vinyl ester; hybrid fibers from combinations of the above (e.g. carbon/born hybrid fiber); among others.

Fibers used in the construction of a component of a strip can be all the same throughout the component—referred to as homogeneous—or the fibers can be mixed of various fiber types—referred to as heterogeneous. In some versions, a strip includes one or more components that have both nonmetallic fibers or bands along with metallic fibers or bands. Such strips having both metallic and nonmetallic portions are sometimes referred to as hybrid strips. Also, in some versions, fibers can be coated with polymeric materials, as described further below, to enhance their strength and durability properties.

1. Glass Fibers

The main ingredient of glass fiber is silica ($SiO_2$), and glass fiber contains smaller portions of barium oxide ($B_2O_3$) and aluminum oxide ($Al_2O_3$) added to the silica. Other ingredients include calcium oxide (CaO) and magnesium oxide (MgO). In general, glass fibers have high tensile strength, high chemical resistance, and excellent insulation properties. Glass fibers include E-glass, S-glass, and C-glass. C-glass has a higher resistance to corrosion than E-glass. S-glass has the highest tensile strength of the glass fibers. E-glass and C-glass fibers have low sodium oxide ($Na_2O$) and potassium oxide ($K_2O$) content which attributes to corrosive resistance to water and high surface resistivity.

2. Carbon Fibers

Carbon fibers exhibit high tensile strength-to-weight ratios and tensile-to-modulus ratios. Tensile strengths can range from 30,000 ksi up to 150,000 ksi, far exceeding that of glass fibers. Carbon fibers have a very low coefficient of thermal expansion, high fatigue strengths, high thermal conductivity, low strain-to-failure ratio, low impact resistance, and high electrical conductivity. Carbon fibers are a product of graphitic carbon and amorphous carbon, and the high tensile strength is associated with the graphitic form. The chemical structure of carbon filaments consists of parallel regular hexagonal carbon groupings.

Carbon fibers can be categorized by their properties into the following groups: ultra high modulus (UHM)—where the modulus of elasticity is greater than 65400 ksi; high modulus (HM)—where the modulus of elasticity is in the range 51000-65400 ksi; intermediate modulus (IM)—where the modulus of elasticity is in the range 29000-51000 ksi; high tensile, low modulus (HT)—where tensile strength is greater than 436 ksi and the modulus of elasticity is less than 14500 ksi; super high tensile (SHT)—where the tensile strength is greater than 650 ksi.

Carbon fibers can also be classified according to manufacturing methods, e.g. PAN-based carbon fibers and pitch-based carbon fibers. With PAN-based carbon fibers, the carbon fibers are produced by conversion of polyacrylonitrile (PAN) precursor to carbon fibers through stages of oxidation, carbonization (graphitization), surface treatment, and sizing. With pitch-based carbon fibers, the carbon fibers are produced by spinning filaments from coal tar or petroleum asphalt (pitch), curing the fibers at high temperature, and carbonization in a nitrogen atmosphere at high temperature. Table 1 shows properties of exemplary carbon fibers. Furthermore, Table 2 shows a comparison of properties of standard carbon to high tensile steel.

TABLE 1

Properties of Exemplary Carbon Fibers

| Mfg. Method | Name | Mfr. | Tensile Modulus (msi) | Tensile Strength (ksi) | Comp Strength (ksi) | Fiber TC (W/mK) | Fiber Density (g/cc) | Fiber Elong (%) | Tow Sizes (K) |
|---|---|---|---|---|---|---|---|---|---|
| PAN | M40J | Toray | 54 | 640 | >175 | — | 1.77 | 1.2 | 6/12 |
| | M55J | Toray | 78 | 585 | 125 | — | 1.91 | 0.8 | 6 |
| PITCH | K13710 | Mitsubishi | 92 | 500 | 55 | 220 | 2.12 | — | 10 |
| | K1392U | Mitsubishi | 110 | 540 | 58 | 210 | 2.15 | 0.5 | 2 |
| | K800 | Amoco | 125 | 300 | — | 800 | 2.15 | — | 2 |
| | K13C2U | Mitsubishi | 130 | 550 | 57 | 620 | 2.2 | 0.4 | 2 |
| | K1100 | Amoco | 135 | 460 | 30 | 1100 | 2.2 | 0.25 | 2 |
| | K13D2U | Mitsubishi | 140 | 580 | 50 | 790 | 2.15 | — | — |

TABLE 2

Properties of Carbon Fiber and Steel

| Material | Tensile Strength (GPa) | Tensile Modulus (GPa) | Density (g/ccm) | Specific Strength (GPa) |
|---|---|---|---|---|
| Standard Grade Carbon Fiber | 3.5 | 230.0 | 1.75 | 2.00 |
| High Tensile Steel | 1.3 | 210.0 | 7.87 | 0.17 |

3. Hybrid Fibers

One exemplary hybrid fiber combines boron fiber with carbon prepreg. Hy-Bor is the brand name for one such hybrid fiber that combines Mitsubishi Rayon's MR-40 carbon fiber, NCT301 250° F.-cure epoxy resin, and a 4-mil diameter boron fiber. Compared to a comparable carbon fiber alone, the boron-carbon fiber provides increased flexural and compression properties and improved open-hole compression strength. Also, reduced carbon ply-count can be achieved in compression-critical designs. With hybrid fiber designs, such as Hy-Bor, properties can be tailored by varying boron fiber count and carbon prepreg configurations. Table 3 shows properties of exemplary carbon fibers and hybrid carbon-boron fibers.

TABLE 3

Properties of Exemplary Carbon fibers and Carbon-Boron Fibers

| Fiber Type | Tensile Strength (ksi) | Compressive Strength (ksi) |
|---|---|---|
| AS4/EK78 (Carbon fiber) | 303 | 245 |
| Celion 12K/EK78 (Carbon fiber) | 293 | 206 |
| M55J/954-3 (Carbon fiber) | 324 | 136 |
| IM-7/3501-6 (Carbon fiber) | 370 | 210 |
| MR-40/301 (Carbon fiber) | 295 | 180 |
| 4 mil Boron (100 fibers/inch) + MR-40/301 | 235 | 340 |
| 4 mil Boron (208 fibers/inch) + MR-40/301 | 275 | 400 |

4. Aramid Fibers

Aramid fibers are characterized by no melting point, low flammability, and good fabric integrity at elevated temperatures. Para-aramid fibers, which have a slightly different molecular structure, also provide outstanding strength-to-weight properties, high tenacity, and high modulus. One common aramid fiber is produced under the brand Kevlar. Other brands of aramid fibers include Twaron, Technora, and Nomex. Three grades of Kevlar available are Kevlar 29, Kevlar 49, and Kevlar 149. The tensile modulus and strength of Kevlar 29 is roughly comparable to that of E-glass or S-glass, yet its density is almost half that of glass. Thus, in some applications, Kevlar can be substituted for glass where lighter weight is desired. Table 4 shows the differences in material properties among the different grades of Kevlar. Furthermore, Table 5 shows a comparison for some properties of exemplary glass, carbon, and aramid fibers.

TABLE 4

Properties of Kevlar Grades

| Kevlar Grade | Density g/cm^3 | Tensile Modulus GPa | Tensile Strength GPa | Tensile Elongation % |
|---|---|---|---|---|
| 29 | 1.44 | 83 | 3.6 | 4.0 |
| 49 | 1.44 | 131 | 3.6-4.1 | 2.8 |
| 149 | 1.47 | 186 | 3.4 | 2.0 |

TABLE 5

Properties of Exemplary Fibers

| Fiber type | Diameter, micron | Density, g/cc | Tensile strength, ksi | Tensile modulus, Msi | Elongation at break, % |
|---|---|---|---|---|---|
| E-glass | 8-14 | 2.5 | 500 | 10 | 4.9 |
| S-glass | 10 | 2.5 | 665 | 12 | 5.7 |
| Carbon (standard modulus) | 7 | 1.8 | 600 | 33 | 1.6 |
| Aramid (Kevlar 49) | 12 | 1.45 | 550 | 19 | 30 |

5. Poly(p-phenylene-2,6-benzobisoxazole) (PBO)

PBO is an example of another synthetic polymeric fiber, like aramid fibers. PBO fiber is characterized by extremely high ultimate tensile strength (UTS), high elastic modulus, and good electrical insulation. Zylon is one recognized brand of PBO fiber. PBO is an aromatic polymer which contains the heterocycle instead of the amide bonding to obtain higher elastic modulus than the aramid fiber. Some advantages of PBO include: superior creep resistance to p-aramid fibers; higher strength-to-weight ratio than carbon fiber; 100° C. higher decomposition temperature than p-aramid fibers; extremely high flame resistance; lower moisture regain compared to p-aramid fiber; and abrasion resistance higher than p-aramid fiber under the same load. Table 6 shows some mechanical properties of Zylon fiber. Table 7 shows a comparison of properties of exemplary fiber reinforcements that can be used with a matrix material to make fiber-reinforced polymers. Furthermore Table 8 and Table 9 shows a comparison of some mechanical properties of exemplary fibers.

TABLE 6

Properties of Zylon Fiber

| | |
|---|---|
| Fiber type | Zylon HM (111 tex)* |
| Density [g/cm3] | 1.56 |
| Ultimate tensile strength [GPa] | 5.8 |
| E-modulus [GPa] | 280 |
| Elongation at break [%] | 2.5 |
| Thermal expansion coeff. [1/K] | $-6 \times 10^{-6}$ |
| Dielectric constant | 2.1 |

*1 tex = 1 gram/km

TABLE 7

Property Comparison Among Exemplary Fiber Reinforcement Materials

| Material | Tensile Strength (GPa) | Tensile Modulus (GPa) | Density (g/ccm) | Specific Strength (GPa) |
|---|---|---|---|---|
| Carbon | 3.5 | 230.0 | 1.75 | 2.00 |
| Kevlar | 3.6 | 60.0 | 1.44 | 2.50 |
| E-Glass | 3.4 | 22.0 | 2.60 | 1.31 |
| PBO | 5.8 | 280 | 1.56 | — |

TABLE 8

Properties of Exemplary Fiber

| Fiber | Tenacity cN/dtex | Tenacity GPa | Modulus cN/dtex | Modulus GPa | Elongation % | Density g/cm³ | Moisture Regain % | Limiting Oxygen Index (LOI) | Heat Resistance* C. |
|---|---|---|---|---|---|---|---|---|---|
| Zylon ® AS | 37 | 5.8 | 1150 | 180 | 3.5 | 1.54 | 2.0 | 68 | 650 |
| Zylon ® HM | 37 | 5.8 | 1720 | 270 | 2.5 | 1.56 | 0.6 | 68 | 650 |
| p-Aramid (HM) | 19 | 2.8 | 850 | 109 | 2.4 | 1.45 | 4.5 | 29 | 550 |
| m-Aramid | 4.5 | 0.65 | 140 | 17 | 22 | 1.38 | 4.5 | 29 | 400 |
| Steel Fiber | 3.5 | 2.8 | 290 | 200 | 1.4 | 7.8 | 0 | — | — |
| HS-PE | 35 | 3.5 | 1300 | 110 | 3.5 | 0.97 | 0 | 16.5 | 150 |
| PBI | 2.7 | 0.4 | 45 | 5.6 | 30 | 1.4 | 15 | 41 | 550 |
| Polyester | 8 | 1.1 | 125 | 15 | 25 | 1.38 | 0.4 | 17 | 260 |

*melting or decomposition temperature

TABLE 9

Properties of Exemplary Fiber

| Fiber | Tensile Strength (MPa) | Tensile Strength ($10^3$ psi) | Tensile Modulus (Young Modulus) GPa | Tensile Modulus (Young Modulus) ($10^6$ psi) | Elongation (%) | Density (kg/m³) | Density (lb/in³) |
|---|---|---|---|---|---|---|---|
| E-Glass | 3500 | 510 | 72.5 | 10.5 | 4.9 | 2630 | 0.095 |
| S-Glass | 4600 | 670 | 88 | 12.8 | 5.5 | 2490 | 0.09 |
| AS-4 PAN-Based Carbon | 4000 | 578 | 245 | 35.5 | 1.6 | 1800 | 0.065 |
| IM-7 PAN-Based Carbon | 4900 | 710 | 317 | 46 | 1.7 | 1744 | 0.063 |
| P120 Pitch-Based Graphite | 2250 | 325 | 827 | 120 | 0.27 | 2187 | 0.079 |
| Alumina/Silica | 1950 | 280 | 297 | 43 | — | 3280 | 0.12 |
| Kevlar 29 | 2860 | 410 | 64 | 9.3 | — | 1440 | 0.052 |
| Kevlar 49 | 3650 | 530 | 124 | 18 | 2.5 | 1440 | 0.052 |
| Boron | 3620 | 525 | 400 | 58 | 1 | 2574 | 0.093 |

6. Oriented Fiber, Fiber Orientation, Fiber Length

At the fiber level, orientation pertains to the manner in which the fiber itself was formed (sometimes referred to as oriented fiber). At the strip level, orientation pertains to the manner in which the fibers were laid to form the strip (sometimes referred to as fiber orientation). At both levels, orientation can impact the overall mechanical properties of exemplary strips. With respect to oriented fiber, such fiber generally shows high tensile strength, high tensile modulus, and low breakage elongation. By way of example only, with synthetic fibers the orientation technique may be achieved using an extrusion process in which a polymer solution is extruded with a specific concentration during manufacture of the fiber.

When laying the fiber elements in constructing an exemplary strip, fibers laid in the longitudinal direction, or direction parallel to the load, exhibit higher tensile strength compared to strips where fibers are not laid with a specific orientation, or where fibers are laid in the transverse direction, or perpendicular to the load. Fibers laid in the transverse direction can provide improved durability of strips, e.g. by adding strength in the cross direction to keep longitudinally oriented fibers from separating.

Fiber length can also play a part in the design of exemplary strips. For instance using short fibers where appropriate can help make more cost effective strips due to the generally lower cost of short fibers compared to long fibers. In some versions short fibers are arranged primarily in the length direction of a strip, and are used to reinforce strip (100). Of course, short fibers can be arranged in the transverse direction in other versions. Furthermore, like long fibers, short fibers can be fixed in a matrix material to form composites.

7. Fabrics

As introduced above, fibers are one example category of materials that can be used to deliver strength to a strip. In some versions, fibers can be formed into fabrics by various techniques and then these fabrics can be incorporated into strips either as fabrics alone, or in a polymer-fabric composite. Table 10 below shows some relative properties of exemplary fabrics.

TABLE 10

Relative Properties of Exemplary Reinforcing Fabrics

| Specifications | Fiberglass | Carbon | Aramid |
|---|---|---|---|
| Density | P | E | E |
| Tensile Strength | F | E | G |
| Compressive Strength | G | E | P |
| Stiffness | F | F | G |
| Fatigue Resistance | G-E | G | E |
| Abrasion Resistance | F | F | E |
| Sanding/Machining | E | E | P |
| Conductivity | P | E | P |
| Heat Resistance | E | E | F |
| Moisture Resistance | G | G | F |
| Resin Compatibility | E | E | F |
| Cost | E | P | F |

P = Poor,
F = Fair,
G = Good,
E = Excellent.

Fabrics can be made or constructed by using a number of techniques where the fabric produced can be woven, knit, non-woven, braided, netted, or laced. Weaving includes where two sets of yarn are interlaced with one another at right angles. Weaving can provide a firm fabric. Knitting includes interloping fibers to make a fabric. Knitting can provide a fabric with good stretch properties. Non-woven fabrics are made directly from fibers without weaving or knitting. Instead, fibers are held together by mechanical or chemical forces. Braided fabrics are created in a fashion similar to braiding of hair. Fabric nets include open-mesh fabrics with geometrical shapes where the yarn may be knotted at the point of intersection. Laced fabrics can include where fiber in the form of yarn may be criss-crossed to create intricate designs. The yarns can be interlooped, interlaced, or knotted to give an open-mesh fabric.

In terms of woven fabrics, there are several weave styles that can be used when forming a fabric for use with strips. By way of example only, and not limitation, these weave styles can include: plain; twill; satin; basket; leno; mock leno; knit; multi-component interlaced; 3-D orthogonal; angle interlock; warp interlock; among others. The style of woven fabric can affect the physical properties of a strip. For example, plain woven fabrics are relatively lower in terms of pliability relative to comparable fabrics with other weaves. Plain weaves further are relatively easier to cut and handle because they do not unravel easily. Generally, fibers provide their greatest strength when they are straight. The frequent over/under crossing of the fibers can reduce the strength of the fibers and this can be a factor in woven fabrics. For example, in some cases twill weaves and satin weaves provide relatively high pliability and strength compared to comparable plain weave fabrics as fibers in plain weave fabrics can have greater over/under crossing. In an exemplary satin weave, one filling yarn floats over three to seven other warp threads before being stitched under another warp thread. Thus fibers run straighter much longer in this loosely woven satin type, maintaining the theoretical strengths of the fiber. In some versions, these longer fiber runs also produce greater pliability and these fabrics conform more easily to complex shapes. In some versions, twill weaves offer a compromise between the satin and plain weave types in terms of strength and pliability. Below, Table 11 shows some exemplary fabric styles in relation to some exemplary functions and features in a strip design, while Table 12 shows a comparison of relative properties of various weave styles.

TABLE 11

Exemplary Weave Styles Relative to Exemplary Strip Functions

| Strip Function | Plain | Twill | Satin | Basket | Leno | Mock Leno | Knit |
|---|---|---|---|---|---|---|---|
| Load carrying | x | xxxx | xxxx | xxx | x | xxx | x |
| Protectant | xx | xxxx | xxxx | xxx | x | xxx | x |

TABLE 11-continued

Exemplary Weave Styles Relative to Exemplary Strip Functions

| Strip Function | Plain | Twill | Satin | Basket | Leno | Mock Leno | Knit |
|---|---|---|---|---|---|---|---|
| Safety | x | xxxx | xxxx | xxx | x | xxx | x |
| Transmission | xx | xxxx | xxxx | xxx | xx | xxx | xx |

greater "x" markings indicate greater preference for the function

TABLE 12

Relative Properties of Exemplary Weave Styles

| Property | Plain | Twill | Satin | Basket | Leno | Mock Leno | Knit |
|---|---|---|---|---|---|---|---|
| Good stability | *** | *** | ** | ** | ***** | *** | *** |
| Good drape | ** | **** | ***** | *** | * | ** | *** |
| Low porosity | *** | **** | ***** | ** | * | *** | * |
| Smoothness | ** | *** | ***** | ** | * | ** | ** |
| Balance | **** | **** | ** | **** | ** | **** | *** |
| Symmetrical | ***** | *** | * | *** | * | **** | *** |
| Low crimp | ** | *** | ***** | ** | ***** | ** | *** |

***** = excellent
**** = good
*** = acceptable
** = poor
* = very poor

Like woven materials, braided fabrics include fibers that are mechanically interlocked with one another. Virtually any fiber with a reasonable degree of flexibility and surface lubricity can be economically braided. Typical fibers include aramid, carbon, ceramics, fiberglass, as well as other various natural and synthetic fibers. Fibers in braided fabrics are continuous, and this contributes to braided fabrics providing a generally even distribution of load throughout the structure. This distribution of load also contributes to the impact resistance of braided structures. In some versions with strips comprised of composite braided fabrics, a relatively stronger, tougher, and/or more flexible strip is produced relative to a comparable composite woven fabric.

B. Polymers

Polymers define a class of materials that can serve various purposes when constructing a strip or components of a strip. Polymers can be used in strips alone, or as a matrix material to bind fibers to form a composite fabric or network of fiber and polymer. In some versions, the polymers are thermosetting type while in other versions the polymers are thermoplastic type. Table 13 lists examples of thermoplastic and thermosetting polymers. Table 14 shows properties of exemplary thermoplastic materials. Table 15 shows properties of exemplary polymer materials. The paragraphs following the tables describe polymers that can be used either alone or as matrix materials in fiber-polymer composites.

TABLE 13

Some Examples of Thermoplastic and Thermoset Polymers

| Thermoplastic | | Thermoset |
|---|---|---|
| Acrylonitrile-Butadiene-Styrene, (ABS) | Polyetheretherketone, (PEEK) | Allyl Resin, (Allyl) |
| Cellulosic | Polyetherimide, (PEI) | Epoxy |
| Ethylene vinyl alcohol, (E/VAL) | Polyethersulfone, (PES) | Melamine formaldehyde, (MF) |
| Fluoroplastics, (PTFE), (FEP, PFA, CTFE, ECTFE, ETFE) | Polyethylene, (PE) | Phenol-formaldehyde Plastic, (PF), (Phenolic) |
| Ionomer | Polyethylenechlorinates, (PEC) | Polyester |

TABLE 13-continued

| Some Examples of Thermoplastic and Thermoset Polymers | | |
|---|---|---|
| Thermoplastic | | Thermoset |
| Liquid Crystal Polymer, (LCP) | Polyimide, (PI) | Polyimide, (PI) |
| Polyacetal, (Acetal) | Polymethylpentene, (PMP) | Polyurethane, (PU) |
| Polyacrylates, (Acrylic) | Polyphenylene Oxide, (PPO) | Silicone, (SI) |
| Polyacrylonitrile, (PAN), (Acrylonitrile) | Polyphenylene Sulfide, (PPS) | Allyl Resin, (Allyl) |
| Polyamide, (PA), (Nylon) | Polyphthalamide, (PTA) | Epoxy |
| Polyamide-imide, (PAI) | Polypropylene, (PP) | Melamine formaldehyde, (MF) |
| Polyaryletherketone, (PAEK), (Ketone) | Polystyrene, (PS) | |
| Polybutadiene, (PBD) | Polysulfone, (PSU) | |
| Polybutylene, (PB) | Polyurethane, (TPU) | |
| Polycarbonate, (PC) | Polyvinylchloride, (PVC) | |
| Polyektone, (PK) | Polyvinylidene Chloride, (PVDC) | |
| Polyester | Thermoplastic elastomers, (TPE) | |

TABLE 14

| Properties of Exemplary Thermoplastics | | | | | |
|---|---|---|---|---|---|
| Polymer | Density ($kg/m^3$) | Tensile Strength ($N/mm^2$) | Elongation (%) | Young's Modulus ($GN/m^2$) | Brinell Hardiness Number |
| PVC | 1330 | 48 | 200 | 3.4 | 20 |
| Polystyrene | 1050 | 48 | 3 | 3.4 | 25 |
| PTFE | 2100 | 13 | 100 | 0.3 | N/A |
| Polypropylene | 900 | 27 | 200-700 | 1.3 | 10 |
| Nylon | 1160 | 60 | 90 | 2.4 | 10 |
| Cellulose Nitrate | 1350 | 48 | 40 | 1.4 | 10 |
| Cellulose Acetate | 1300 | 40 | 10-60 | 1.4 | 12 |
| Acrylic (metacrylate) | 1190 | 74 | 6 | 3.0 | 34 |
| Polyethylene | 950 | 20-30 | 20-100 | 0.7 | 2 |

TABLE 15

| Properties of Exemplary Polymer Matrix Materials | | | | | |
|---|---|---|---|---|---|
| Matrix Type | Density, g/cc | Tensile Strength, ksi | Tensile Modulus, Msi | Coefficient of Thermal Expansion, $10^{-6}/°$ F. | Glass Transition Temperature, Tg, ° F. |
| Unsaturated Polyester | 1.1-1.5 | 5.8-13 | 0.46-0.51 | 33-110 | 50-110 |
| Vinyl ester | 1.23 | 12.5 | 1.5 | 212-514 | 220 |
| Epoxy | 1.27 | 10 | 0.62 | 25 | 200 |

Vinyl ester: Derkane Momentum 510-A40, Ashland, Inc.
Epoxy: Hercules 3501-6, Hexcel, Inc.

1. Epoxies

Epoxies are prepared by curing a chemical formulation consisting of monomeric materials with reactive functional groups and polymerization additive such as photo- and/or thermal-induced initiators, photo- and/or thermal-stabilizers, accelerators, inhibitors, etc. The monomeric materials can include, but are not limited to, epoxy, isocyanate, polythiols, enes, among others. Epoxy resins themselves consist of monomers or short chain polymers (pre-polymers) terminated with an epoxide group at either end or pendant on the backbone of the molecule.

Epoxy resins have excellent electrical, thermal, and chemical resistance. Some other noteworthy properties of epoxy resins include flexibility, which allows a composite material of epoxy and fiber to absorb a high level of impact force without breaking. Epoxy resin also does not spider-crack when reaching its maximum bending potential (MBP), but instead it will form only a single crack at the stress point. Epoxies also provide resistance to corrosive liquids and environments, good performance at elevated temperatures, and good adhesion to substrates. Epoxy resins can have a transparent finish that allows the appearance of carbon fibers to show through the matrix. Epoxy resins do not shrink, are UV resistant, and can be formulated with different materials or blended with other epoxy resins. Cure rates of epoxy can be controlled to match process requirements through proper selection of hardeners and/or catalyst systems. Different hardeners, as well as quantities of a hardeners, produce different cure profiles, which give different properties to the finished composite.

To make strong material from epoxy, a multifunctional nucleophilic component or hardener is mixed with a multi-functional epoxy resin. Hardeners can include polyamine, polythiol, polyol monomers, and others. The amine —NH2, mercapto —SH, alcohol —OH group react with the epoxide groups to form a covalent bond, so that the resulting polymer is heavily crosslinked, and is thus rigid and strong. The number of functional groups (—SH,

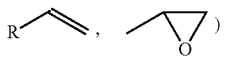

impacts the cross-linking density and, consequently, the rigidity of the final material. Also, incorporating organic moieties in the chemical structure of the cured epoxy will lead to more rigid material. By way of example only, and not limitation, Novolac epoxy resin (DEN 438) and resins possessing aromatic moieties when cured with polythiol gives tough materials.

Various epoxy compounds can be used in construction of strips. Epoxies can be mono-, bi-, multi-functional. Exemplary epoxies include, but are not limited to: diglycidylether of bisphenol A (DGEBA); 1,1,1-tris(p-hydroxyphenyl)ethane triglycidyl ether (THPE); Novolac epoxy resin (DEN 438); cyclo-aliphatic epoxy; triglycidylisocyanurate; trimethylolpropane; triglycidyl ether; ethane-1,2-dithiol; bis(4-mercaptomethylphenyl)ether; N,N,O-triglycidyl derivative of 4-aminophenol; the glycidyl ether/glycidyl ester of salicylic acid; N-glycidyl-N'-(2-glycidyloxypropyl)-5,5-dimethylhydantoin or 2-glycidyloxy-1,3-bis(5,5-dimethyl-1-glycidylhydantoin-3-yl)propane; vinyl cyclohexene dioxide; vinyl cyclohexene monoxide; 3,4-epoxycyclohexylmethyl acrylate; 3,4-epoxy-6-methyl cyclohexylmethyl 9,10-epoxystearate; 1,2-bis(2,3-epoxy-2-methylpropoxy)ethane; UVA 1500 (3,4-epoxycyclohexylmethyl-3',4'-epoxycyclohexanecarboxylate); Heloxy 48 (trimethylol propane triglycidyl ether); Heloxy 107 (diglycidyl ether of cyclohexanedimethanol); Uvacure 1501 and 1502; Uvacure 1530-1534 are cycloaliphatic epoxides blended with polyol; Uvacure 1561 and Uvacure 1562 cycloaliphatic epoxides that have a (meth)acrylic unsaturation in them; UVR-6100, -6105 and -6110 (are all 3,4-epoxy cyclohexylmethyl-3',4'-epoxycyclohexanecarboxylate); UVR-6128 (bis(3,4-epoxycyclohexyl)adipate); UVR-6200; UVR-6216 (1,2-epoxyhexadecane, araldite; CY 179 (3,4-epoxycyclohexylmethyl-3',4'-epoxycyclohexanecarboxylate); PY 284 (digycidyl hexahydrophthalate polymer); Celoxide 2021 (3,4-epoxycyclohexyl methyl-3',4'-epoxycyclohexyl carboxylate); Celoxide 2021 (3',4'-epoxycyclohexanemethyl 3'-4'-epoxycyclohexyl-carboxylate); Celoxide 2081 (3'-4'-epoxycyclohexanemethyl 3',4'-epoxycyclohexyl-carboxylate modified caprolactone); Celoxide 2083; Celoxide 2085; Celoxide 2000; Celoxide 3000; Cyclomer A200 (3,4-epoxy-cyclohexylmethyl-acrylate); Cyclomer M-100 (3,4-epoxy-cyclohexylmethylmethacrylate); Epolead GT-300; Epolead GT-302; Epolead GT-400; Epolead 401; Epolead 403; among others.

Shown below are chemical structures for exemplary epoxy and thiol molecules.

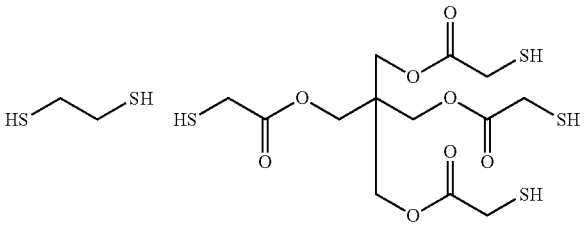

1,2-Ethanedithiol (bi-functional)

Pentaerythritol tetrakis(2-mercaptoacetate

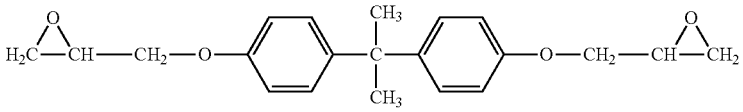

Diglycidylether of bisphenol A(DGEBA)

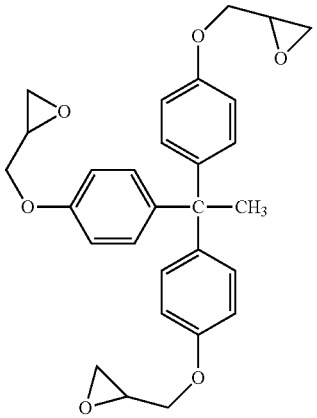

1,1,1-tris(p-hydroxyphenyl) ethane triglycidyl ether (THPE)

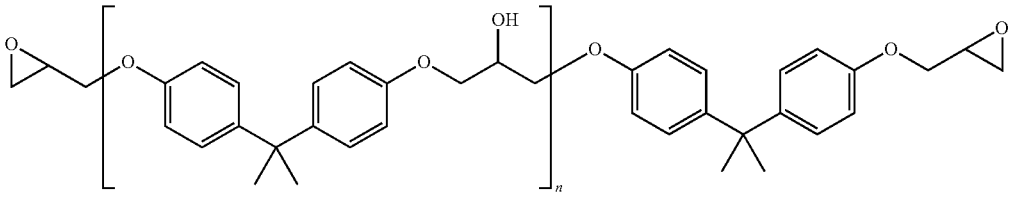

Structure of epoxy prepolymer

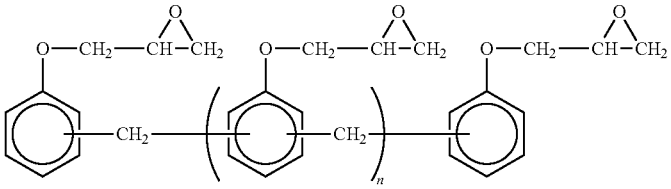

Novolac epoxy resin-DEN 438

Table 16 shows exemplary polythiols and their properties. Following the table are chemical structures for the listed polythiols.

TABLE 16

Properties of Exemplary Polythiols

| | PETMP | TMPMP | GDMP | PETMA | TMPMA | GDMA |
|---|---|---|---|---|---|---|
| Product name | Pentaerythritol Tetra-(3-mercapto-propionate) | Trimethylol-propane Tri-(3-mercapto-propionate) | Glycol Di-(3-mercapto-propionate) | Pentaerythritol Tetramer-captoacetate | Trimethylol-propane Tri-mercapto-acetate | Glycol Dimercapto-acetate |
| SH-functionality | 4 | 3 | 2 | 4 | 3 | 2 |
| molecular weight [g/mol] | 488.2 | 398.6 | 238.3 | 432.5 | 356.5 | 210.2 |
| SH-content [w/w %] | ~26 | ~24 | ~26.8 | ~29 | ~26.5 | ~30.5 |
| viscosity at RT [Pas] | 0.45 | 0.124 | unknown | crystallizes at RT | 0.145 | unknown |
| refractive index | ~1.532 | ~1.52 | ~1.51 | ~1.547 | ~1.531 | ~1.519 |

PETMP

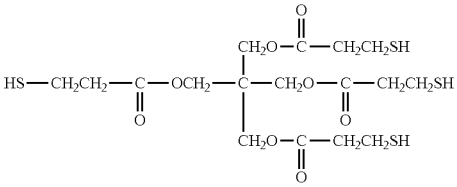

TMPMP

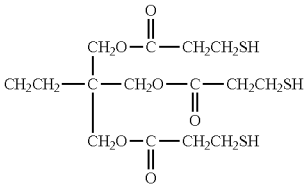

GDMP

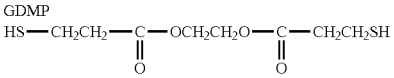

PETMA

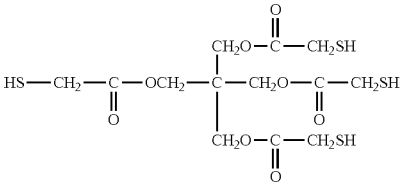

TMPMA

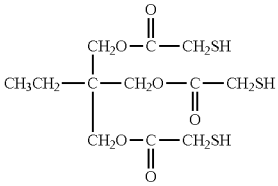

GDMA

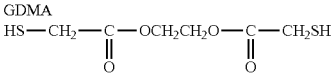

As mentioned above, to improve the rigidity in a cured epoxy using polythiol, the chemical structure of the polythiol can be altered to incorporate aromatic moieties. Below is one exemplary reaction scheme for synthesizing a polythiol incorporating aromatic moieties.

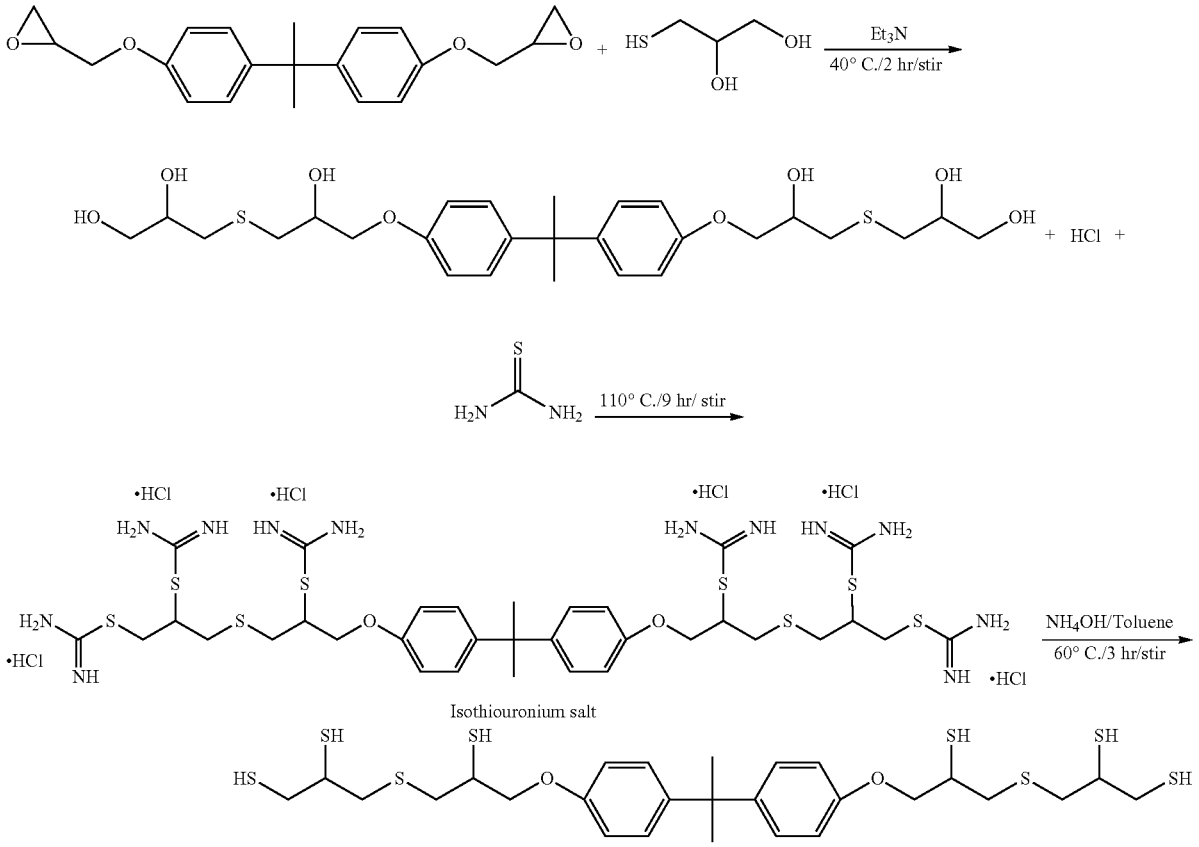

In addition to thiol-cured epoxies being used in some versions of a strip, in the same and/or other versions a hybrid epoxy, thiol-epoxy/thiol-ene, can be used. As introduced above, the expression "thiol" is used to represent the compound having mercapto group(s), —SH. The expression "ene" is used to represent the compound having unsaturated group(s)

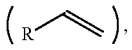

such as acrylate, methacrylate, dien, allyl groups. Below is an exemplary hybrid thiol-epoxy/thiol-ene system showing the monomers used in such a system, which are bisphenol A diglycidyl ether (BADGE, epoxy), pentaerythritol tetra(3-mercaptopropionate) (PETMP, thiol), and triallyl-1,3,5-triazine-2,4,6-trione (TATATO, ene).

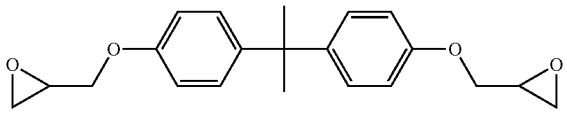

BADGE (epoxy)

-continued

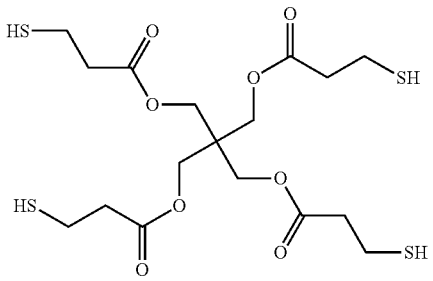

PETMP (thiol)

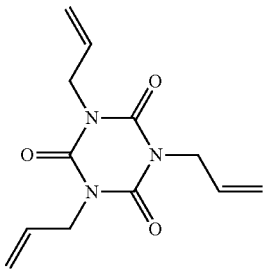

TATATO (enc)

Some of the properties of the thiol-cured epoxy and the hybrid thiol-epoxy/thiol-ene systems include: thermally and UV curable; ease of adjusting the viscosity of the formulation; control of the stiffness of final product by controlling the molecular structure as well as the cross-linking density; high abrasion, chemical, moisture, and fire resistance; among others.

2. Polyurethanes

Another polymer with mechanical properties that are suitable for use with a strip is polyurethane: Polyurethane resin has two components: polyol and isocyanate. By varying the mix ratio of these components, polyurethane can be made flexible, semi-rigid, and rigid. Depending on the intended use, polyurethane can provide resistance to abrasion, impact and shock, temperature, cuts and tears, oil and solvents, and aging.

Figure 37:
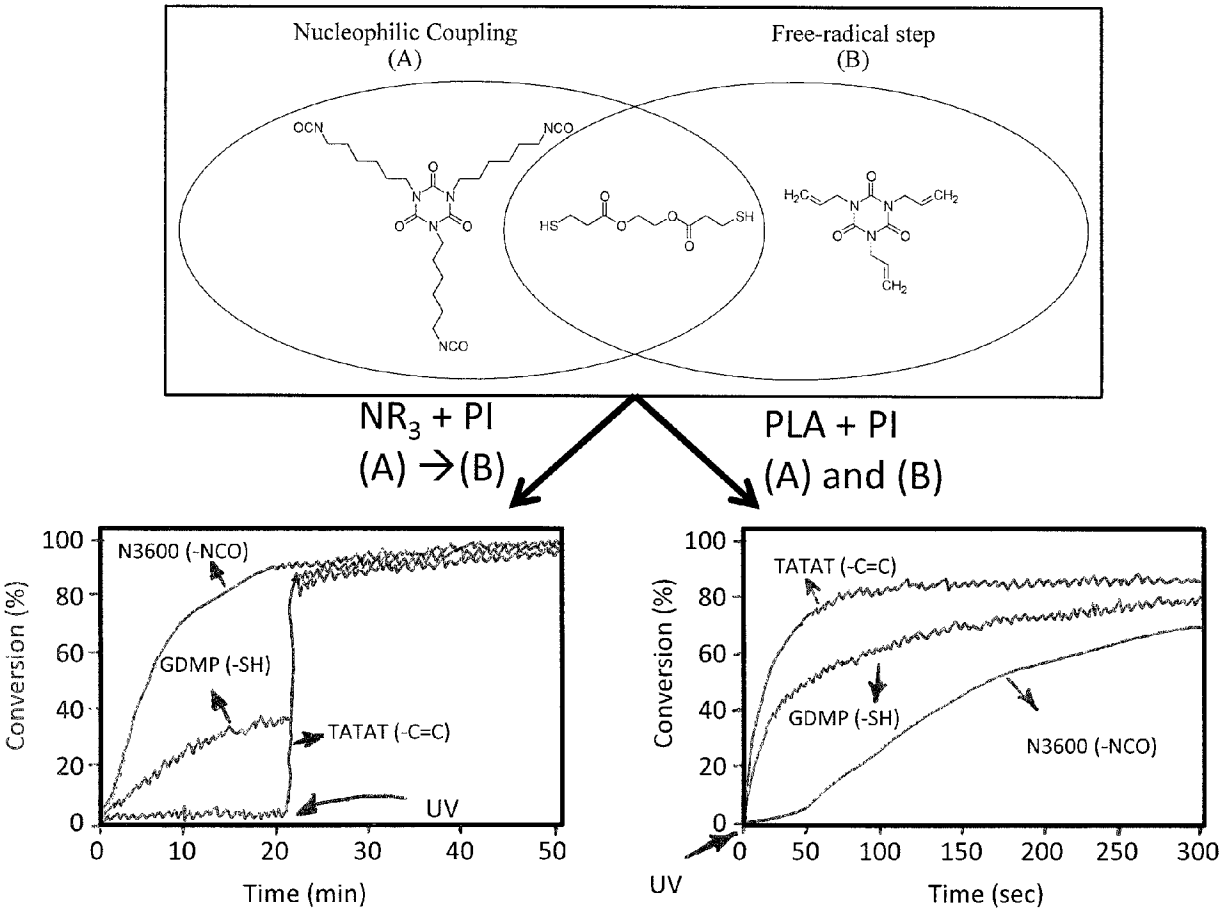
FIG. 37 depicts an exemplary reaction scheme for creating a thiol-isocyanate-ene ternary system.

In some versions the material for use in a strip includes modifying urethane and/or polyurethane compounds to produce thiocarbamates, which are hybrid networks of sulphur-containing polymer matrix. For example, thiol-isocyanate-ene ternary networks, with systematic variations of composition ratio, can be prepared by sequential and simultaneous thiol-ene and thiol-isocyanate click reactions. The thiol-isocyanate coupling reaction can be triggered thermally or photolytically to control the sequence with the thiol-ene photopolymerization. Triethyl amine (TEA) and 2,2-dimethoxy-2-phenyl acetophenone (DMPA) can be used for the sequential thermally induced thiol-isocyanate coupling and photochemically initiated thiol-ene reaction, respectively. A thermally stable photolatent base catalyst (tributylamine-tetraphenylborate salt, TBA.HBPh4) capable of in situ generation of tributylamine by UV light can be used with isopropylthioxanthone (ITX) for the simultaneous thiol-isocyanate/thiol-ene curing systems. The kinetics of the hybrid networks investigated using real-time IR indicate that both thiol-isocyanate and thiol-ene reactions can be quantitatively rapid and efficient (>90% of conversion in a matter of minutes and seconds, respectively). The glass transition temperature (Tg) of the thiourethane/thiol-ene hybrid networks progressively increases (−5 to 35° C. by DSC) as a function of the thiourethane content due to the higher extent of hydrogen bonding, also resulting in enhanced mechanical properties. Highly uniform and dense network structures exhibiting narrow full width at half-maximum (10° C.) can be obtained for both the sequential and the simultaneous thiol click reactions, resulting in identical thermal properties that are independent of the sequence of the curing processes. FIG. 37 depicts an exemplary reaction scheme for creating a thiol-isocyanate-ene ternary system.

In other versions where a strip comprises polymer materials, the polymer consists of thiol-epoxy-ene ternary networks or epoxy-isocyanate-thiol systems. To take advantage of both urethane and epoxy properties, a thiol-isocyanate-ene-epoxy quaternary system can be used in some versions of strips. These matrix materials can provide mechanical properties showing improved flexibility.

Still in other versions a strip comprises polymers having, mercaptan-terminated polythiourethanes, that can be applied as curing agents for epoxy resin. The formulation can consist of a diglycidyl ether of bisphenol A epoxy resin, and polythiourethane curing agent accelerated with primary or tertiary amine. The physico-mechanical and chemical resistance performance can be controlled with adjusting the amount of polythiourethane hardener. In addition, polythiourethane hardeners can have high reactivity toward curing of epoxy resins at low-temperature conditions (−10° C.). Polythiourethane-cured epoxy resins thus stand as an effective material where high performance is needed in terms of physico-mechanical properties as well as chemical resistance.

In other examples, thiourethane binary systems can be used. Shown below is an exemplary controlled reversible addition-fragmentation chain transfer (RAFT) homopolymerization of an unprotected isocyanate-containing monomer, e.g. 2-(acryloyloxy)ethylisocyanate (AOI), to produce a thiourethane.

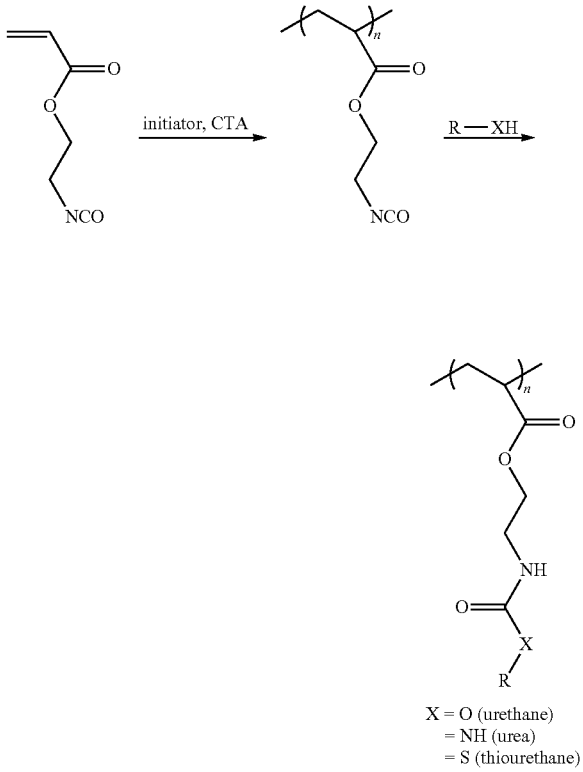

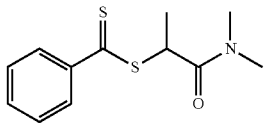

Similarly, below is an another way that depicts the reaction scheme from above to produce a thiourethane binary system, specifically, side-chain functionalization of poly(2-(acryloyloxy)ethylisocyanate) (PAOI) with mercaptoethanol and ethanolamine.

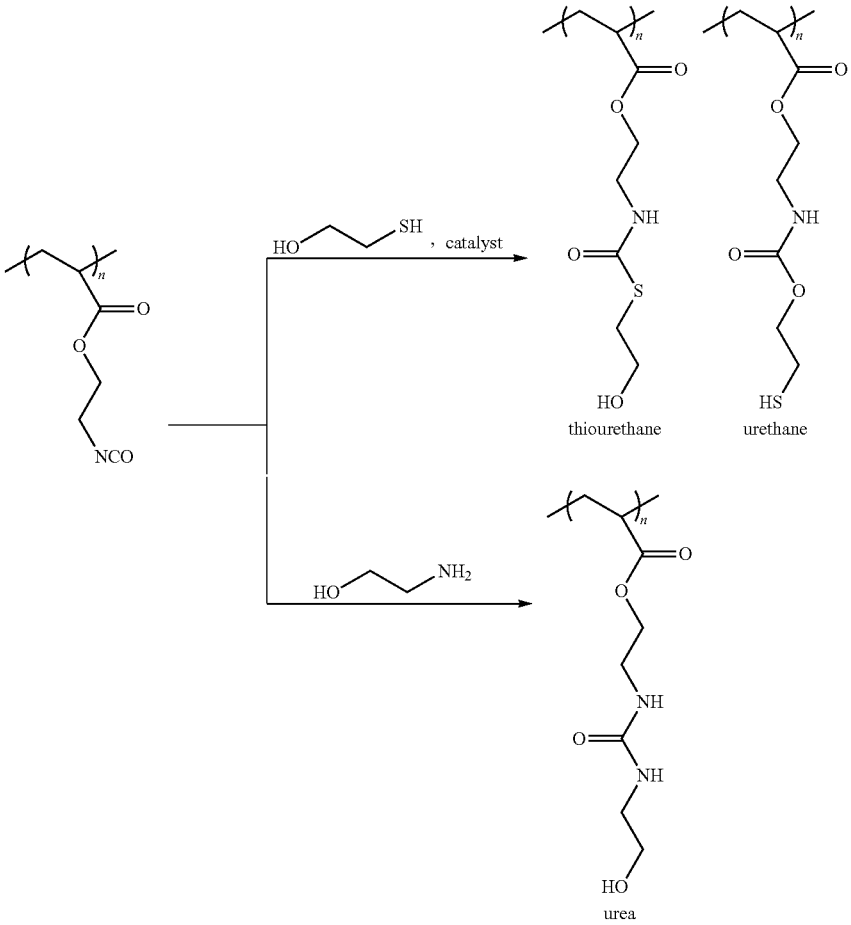

3. Unsaturated Materials (Enes)

As mentioned above in the context of epoxies and polyurethanes, unsatureated materials can be beneficial in terms of producing strong matrix materials through curing reactions that produce extensive cross-linking. Such unsaturated materials include conjugated dienes, allyl compounds, acrylates, and methacrylates.

By way of example only, and not limitation, exemplary conjugated dienes include: isoprene; 1,4-butadiene; 1,2-butadiene; 2-methyl-1,3-butadiene; 2-ethyl-1,3butadiene; 2-butyl-1,3-butadiene; 2-pentyl-1,3-butadiene; 2-hexyl-1,3-butadiene; 2-heptyl-1,3-butadiene; 2-octyl-1,3butadiene; 2-nonyl-1,3-butadiene; 2-decyl-1,3-butadiene; 2-dodecyl-1,3-butadiene; 2-tetradecyl-1,3-butadiene; 2-hexadecyl-1,3-butadiene; 2-isoamyl-1,3-butadiene; 2-phenyl-1,3-butadiene; 2-methyl-1,3-pentadiene; 2-methyl-1,3-hexadiene; 2-methyl-1,3-heptadiene; 2-methyl-1,3-octadiene; and 2-methyl-6-methylene-2,7-octadiene. By way of example only, and not limitation, exemplary allyl monomers include: triallyl-1,3,5-triazine-2,4,6-trione (TATATO), allyl alcohol, allyl chloride, allyl bromide, allyl isothiocyanate, allyl isocyanate, allyl amine, diallylether bisphenol A (DAEBPA), ortho-diallyl bisphenol A (O-DABPA), hydroxypolyethoxy (10) allyl ether (AAE-10), allyl phenyl ether (APE), 2-allylphenol (2-AP), diallyl chlorendate (BX-DAC), 1-allyloxy-2,3-propane diol (APD), diallyl maleate (DIAM), triallyl trimellitate (BX-TATM), among others.

By way of example only, and not limitation, exemplary acrylates include: allyl methacrylate, tetrahydrofurfuryl methacrylate, isodecyl methacrylate, 2-(2-ethoxyethoxy) ethylacrylate, stearyl acrylate, tetrahydrofurfuryl acrylate, lauryl methacrylate, stearyl acrylate, lauryl acrylate, 2-phenoxyethyl acrylate, 2-phenoxyethyl methacrylate, glycidyl methacrylate, isodecyl acrylate, isobornyl methacrylate, isooctyl acrylate, tridecyl acrylate, tridecyl methacrylate, caprolactone acrylate, ethoxylated nonyl phenol acrylate, isobornyl acrylate, polypropylene glycol monomethacrylate, or a combination thereof.

Still by way of example only, and not limitation, in other versions of exemplary acrylates the first monomer comprises ODA-N®, which is a mixture of octyl acrylate and decyl acrylate, EBECRYL 110®, which is an ethoxylated phenol acrylate monomer, EBECRYL 111®, which is an epoxy monoacrylate, or EBECRYL CL 1039®, which is a urethane monoacrylate. In yet other versions of exemplary acrylates the first monomer is octyl acrylate, decyl acrylate, tridecyl acrylate, isodecyl acrylate, isobornyl acrylate, or a combination thereof.

In other versions using multi-functional acrylate monomers for high density cross-linking, by way of example only, and not limitation, such acrylate monomers can include: trimethylolpropane triacrylate; pentaerythritol triacrylate; trimethylolpropane ethoxy triacrylate; or propoxylated glyceryl triacrylate. Still by way of example only, and not limitation, in some versions of exemplary multi-functional acrylates the triacrylate is trimethylolpropane triacrylate or pentaerythritol tetraacrylate. Aromatic tri(meth)acrylates can be obtained by the reaction of triglycidyl ethers of trihydric phenols, and phenol or cresol novolaks containing three hydroxyl groups, with (meth)acrylic acid.

Acrylate-containing compound includes a compound having at least one terminal and/or at least one pendant, i.e. internal, unsaturated group and at least one terminal and/or at least one pendant hydroxyl group, such as hydroxy mono(meth)acrylates, hydroxy poly(meth)acrylates, hydroxy monovinylethers, hydroxy polyvinylethers, dipentyaerythritol pentaacrylate (SR® 399), pentaerythritol triacrylate (SR® 444), bisphenol A diglycidyl ether diacrylate (Ebecryl 3700), poly(meth)acrylates: SR® 295 (pentaerythritol tetracrylate); SR® 350 (trimethylolpropane trimethacrylate), SR® 351 (trimethylolpropane triacrylate), SR® 367 (Tetramethylolmethane tetramethacrylate), SR® 368 (tris(2-acryloxy ethyl)isocyanurate triacrylate), SR® 399 (dipentaerythritol pentaacrylate), SR® 444 (pentaerythritol triacrylate), SR® 454 (ethoxylated trimethylolpropane triacrylate), SR® 9041 (dipentaerythritol pentaacrylate ester), CN® 120 (bisphenol A-epichlorhydrin diacrylate) and others.

C. Composites

As introduced above, in some versions of a strip components are comprised of composite material made from fiber and a polymer matrix. The matrix material can function to transfer stress between the reinforcing fibers, act as a glue to hold the fibers together, and protect the fibers from mechanical and environmental damage. Also, the matrix material can provide some measure of strength and stiffness; however, generally the fibers serve the bulk of the load carrying function and thus contribute greatly to the strength characteristics of the strip.

Below, Table 17 shows a comparison of modulus ratios for exemplary rigid and flexible composites. Furthermore, Table 18 shows a comparison between the mechanical properties of fiber-reinforced composites and metals.

TABLE 17

Modulus Ratios for Exemplary Composites

| Filamentary composite system | Reinforced Modulus, $E_c$ (Gpa) | Matrix Modulus, $E_r$ (Gpa) | Longitudinal ply Modulus, $E_1$ (Gpa) | Transverse ply Modulus, $E_2$ (Gpa) | Modulus ratio, $E_c/E_r$ | Anisotropy, $E_1/E_2$ |
|---|---|---|---|---|---|---|
| Glass-epoxy | 75.0 | 3.4000 | 50.0 | 18.000 | 22.0 | 2.8 |
| Graphite-epoxy | 250.0 | 3.4000 | 200.0 | 5.200 | 74.0 | 38.0 |
| Nylon-rubber | 3.5 | 0.0055 | 1.1 | 0.014 | 640.0 | 79.0 |
| Rayon-rubber | 5.1 | 0.0055 | 1.7 | 0.014 | 930.0 | 120.0 |
| Steel-rubber | 83.0 | 0.0140 | 18.0 | 0.021 | 5,900.0 | 860.0 |

TABLE 18

Properties of Exemplary Composites and Metals

| | Density g/cm3 | Modulus Gpa (Msi) | Tensile Strength Mpa (ksi) | Yield Strength Mpa (ksi) | Ratio of Modulus to Weight 10−6 m | Ratio of Tensile Strength to Weight 103 m |
|---|---|---|---|---|---|---|
| High-modulus carbon fiber-epoxy matrix (unidirectional) | 1.63 | 215 | 1240 | — | 13.44 | 77.5 |
| High-strength carbon fiber-epoxy matrix (unidirectional) | 1.55 | 137.8 | 1550 | — | 9.06 | 101.9 |
| Kevlar 49 fiber-epoxy matrix (unidirectional) | 1.38 | 75.8 | 1378 | — | 5.6 | 101.8 |
| E-glass fiber-epoxy matrix (unidirectional) | 1.85 | 39.3 | 965 | — | 2.16 | 53.2 |
| Carbon fiber-epoxy matrix (quasi-isotropic) | 1.55 | 45.5 | 579 | — | 2.99 | 38 |
| SAE 1010 steel (cold worked) | 7.87 | 207 | 365 | 303 | 2.68 | 4.72 |
| AISI 4340 steel (quenched and tempered) | 7.87 | 207 | 1722 | 1515 | 2.68 | 22.3 |
| 6061-T6 aluminum alloy | 2.7 | 68.9 | 310 | 275 | 2.6 | 11.7 |
| 7178-T6 aluminum alloy | 2.7 | 68.9 | 606 | 537 | 2.6 | 22.9 |
| INCO 718 nickel alloy (aged) | 8.2 | 207 | 1399 | 1247 | 2.57 | 17.4 |
| 17-7 PH stainless steel (aged) | 7.87 | 196 | 1619 | 1515 | 2.54 | 21 |
| Ti—6Al—4V titanium alloy (aged) | 4.43 | 110 | 1171 | 1068 | 2.53 | 26.9 |

In some versions of strips, a composite having an epoxy matrix reinforced by 50% carbon fibers is used for strip components. In some other versions a composite having an epoxy matrix reinforced by 70% carbon fibers is used for the components of a strip. Still in other versions of a strip, a composite having an epoxy matrix reinforced by 50% Kevlar fibers is used for the components. Tables 19, 20, and 21 show properties for such an exemplary composites.

TABLE 19

Properties of Exemplary Epoxy-Carbon Fiber (50%) Composite
Carbon Fiber Reinforced Polymer (CFRP)
Composition: 50% carbon fibers in epoxy matrix

| Property | Value in metric unit | Value in US unit |
|---|---|---|
| Tensile strength (LW) | 1448 MPa | 210000 psi |
| Tensile strength (CW) | 52 MPa | 7500 psi |
| Compressive strength (LW) | 600 MPa | 87000 psi |
| Compressive strength (CW) | 206 MPa | 30000 psi |
| Shear strength | 93 MPa | 13500 psi |

LW—Lengthwise direction,
CW—Crosswise direction

TABLE 20

Properties of Exemplary Epoxy-Carbon Fiber (70%) Composite
Carbon Fiber Reinforced Polymer (CFRP)
Composition: 70% carbon fibers in epoxy matrix

| Property | Value in metric unit | Value in US unit |
|---|---|---|
| Density | $1.6 * 10^3$ kg/m$^3$ | 101 lb/ft$^3$ |
| Tensile modulus (LW) | 181 GPa | 26300 ksi |
| Tensile modulus (CW) | 10.3 GPa | 1500 ksi |
| Tensile strength (LW) | 1500 MPa | 215000 psi |
| Tensile strength (CW) | 40 MPa | 5800 psi |
| Thermal expansion (20° C., LW) | $0.02 * 10^{-6}$° C.$^{-1}$ | $0.01 * 10^{-6}$ in/(in * ° F.) |
| Thermal expansion (20° C., CW) | $22.5 * 10^{-6}$° C.$^{-1}$ | $12.5 * 10^{-6}$ in/(in * ° F.) |

LW—Lengthwise direction,
CW—Crosswise direction

TABLE 21

Properties of Exemplary Epoxy-Aramid Fiber (50% Kevlar) Composite
Kevlar (Aramid) Fiber Reinforced Polymer
Composition: 50% Kevlar (Aramid) unidirectional fibers in epoxy matrix

| Property | Value in metric unit | Value in US unit |
|---|---|---|
| Density | $1.4 * 10^3$ kg/m$^3$ | 87 lb/ft$^3$ |
| Tensile modulus (LW) | 76 GPa | 11000 ksi |
| Tensile modulus (CW) | 5.5 GPa | 800 ksi |
| Shear modulus | 2.3 GPa | 330 ksi |
| Tensile strength (LW) | 1400 MPa | 203000 psi |
| Tensile strength (CW) | 12 MPa | 1700 psi |
| Compressive strength (LW) | 235 MPa | 34000 psi |
| Compressive strength (CW) | 53 MPa | 7700 psi |
| Shear strength (LW) | 34 MPa | 4900 psi |
| Thermal expansion (20° C., LW)) | $-4 * 10^{-6}$° C.$^{-1}$ | $-2.2 * 10^{-6}$ in/(in * ° F.) |
| Thermal expansion (20° C., CW) | $80 * 10^{-6}$° C.$^{-1}$ | $44 * 10^{-6}$ in/(in * ° F.) |

LW—Lengthwise direction,
CW—Crosswise direction

By way of example only, and not limitation, other exemplary composite materials and their properties are shown in Table 22 and 23 below.

TABLE 22

Properties of Exemplary Fiber Filled Thermosetting Plastics

| Polymer | Density (kg/m$^3$) | Tensile Strength (N/mm$^2$) | Elongation (%) | Young's Modulus (GN/m$^2$) | Brinell Hardiness Number |
|---|---|---|---|---|---|
| Epoxy resin, glass filled | 1600-2000 | 68-2000 | 4 | 20 | 38 |
| Melamine formaldehyde, fabric filled | 1800-2000 | 60-90 | N/A | 7 | 38 |
| Urea formaldehyde, cellulose filled | 1500 | 38-90 | 1 | 7-10 | 51 |
| Phenol formaldehyde, mica filled | 1600-1900 | 38-50 | 0.5 | 17-35 | 36 |
| Acetals, glass filled | 1600 | 58-75 | 2-7 | 7 | 27 |

TABLE 23

Properties of Exemplary Epoxy and Reinforcing Fabric Composites

| Specifications | Fiberglass Fabric w/Epoxy | Carbon Fabric w/Epoxy | Kevlar ® Fabric w/Epoxy |
|---|---|---|---|
| Fabric Specifications | 9 oz, E-Glass | 5.6 oz., 3K Carbon | 5 oz. Kevlar ® |
| Laminate Construction | 10 Plies Glass | 10 Plies Carbon | 10 Plies Kevlar ® |
| Laminate/Resin Content | 50% Resin/ 50%Glass | 56% Carbon/44% Resin | 51% Kevlar ®/49% Resin |
| Elongation @ Break % | 1.98% | 0.91% | 1.31% |
| Tensile Strength, PSI | 45,870 PSI | 75,640 PSI | 45,400 PSI |
| Tensile Modulus, PSI | 2,520,000 PSI | 8,170,000 PSI | 3,770,000 PSI |
| Flexural Strength, PSI | 66,667 PSI | 96,541 PSI | 34,524 PSI |
| Flexural Modulus, PSI | 3,050,000 PSI | 6,480,000 PSI | 2,500,000 PSI |

D. Additives

To provide processing or material benefits, various additives can be used when forming composites. Some exemplary additives are discussed in the following paragraphs.

1. Activators and Polymerization Initiators

To promote the curing process of some exemplary epoxy resins combined with a polythiol, for example, an activator can be used. An activator can be a tertiary amine, a latent base, or a radical initiator. Furthermore, an increase in temperature also accelerates the curing reaction.

Polymerization initiators can be incorporated within the polymer matrix composition. In such versions incorporating a polymerization initiator, upon exposure to heat or ultraviolet light, the initiator is converted to a reactive species, which increases the reactivity of the cured coating. Consequently, the fiber coated with such cured composition will be less susceptible to fatigue failure when compared to fibers coated with a composition that does not contain a cationic initiator. By way of example only, and not limitation, free-radical initiators used for polymerization include: 2,2-dimethoxy-2-phenylacetophenone; 1-hydroxycyclohexyl phenyl ketone; 2-methyl-1-{4(methylthio)phenyl}-2-morpholinopropanone-1,2-benzyl-2-N,N-dimethylamino-1-(4-morpholinophenyl)-1-butanone; 2-hydroxy-2-methyl-1-phenyl-propan-1-one; among others.

2. Adhesion Promoters

Adhesion promoter can be used to provide an increase of adhesion between different materials, e.g. between fiber and coating as well as between fiber and composite material. Adhesion promoters generally comprise an organofunctional silane. The term "organofunctional silane" is defined as a silyl compound with functional groups that facilitate the chemical or physical bonding between the substrate surface and the silane, which ultimately results in increased or enhanced adhesion between the polymer matrix and the substrate or fiber. By way of example only, and not limitation, adhesion promoters include: octyltriethoxysilane, methyltriethoxysilane, methyltrimethoxysilane, tris-{3-trimethoxysilyl)propyl isocyanurate, vinyltriethoxysilane, vinyltrimethoxysilane, vinyl-tris-(2-methoxyethoxy)silane, vinylmethyldimethoxysilane, gamma-methacryloxypropyltrimethoxysilane, beta-(3,4-epoxycyclohexyl)ethyltrimethoxysilane, gamma-glycidoxypropyltrimethoxysilane, gamma-mercaptopropyltrimethoxysilane, bis-(3-{triethoxysilyl}propyl-tetrasulfane, gamma-aminopropyltriethoxysilane, amino alky silicone, gamma-aminopropyltrimethoxysilane, N-beta-(aminoethyl)-gamma-aminopropyltrimethoxysilane, bis-(gamma-trimethoxysilylpropyl)amine, N-phenylgamma-aminopropyltrimethoxysilane, organomodified polydimethylsiloxane, N-beta-(aminoethyl)-gamma-aminopropylmethyldimethoxysilane, gamma-ureidopropyltrialkoxysilane, gamma-ureidopropyltrimethoxysilane, gamma-isocyanatopropyltriethoxysilane, and combination thereof.

3. Thermal Oxidative Stabilizer

Thermal oxidative stabilizers inhibit oxidation and thermal degradation of the polymer matrix coating composition. By way of example only, and not limitation, thermal oxidative stabilizers include: octadecyl 3,5-di-tert-butyl-4-hydroxyhydrocinnamate (sold under the trade name IRGANOX1076®); 3,5-bis-(1,1-dimethylethyl)-4-hydroxybenzenepropanoic acid; 2,2,-bis{{3-{3,5-bis-(1,1-dimethylethyl)-4hydroxyphenyl}-1-oxopropoxy}methyl}-1,3-propanediyl ester; thiodiethylene bis-(3,5-tert-butyl-4-hydroxy) hydrocinnamate; or combinations of these.

4. Fillers

In forming composite materials, filler materials can also be used with polymers. In some versions these filler materials are used in addition to fibers, while in other versions these filler materials are used alone with the polymers to form a composite. In the selection of filler materials the following factors can be considered: cost, improved processing, density control, optical effects, thermal conductivity, thermal expansion, electrical properties, magnetic properties, flame retardancy, improved mechanical properties, among others.

Some exemplary filler materials for use in some resins include: Kevlar pulp, chopped granite fibers, glass microspheres, chopped glass fibers, 1/16" or 1/32" milled glass fibers, thixotropic silica, and talc. Kevlar pulp can provide improved abrasion resistance in some version of strip (100) when used in one or more components (114). Chopped granite fibers can provide areas of localized reinforcement. Glass microspheres can be used to fill surface voids, while the short or chopped glass fibers can be used to improve surface strength.

5. Active Carbon Nanotubes

The bonding at the interface between the reinforcement structure, e.g. fiber, and the polymer matrix plays a role in determining the performance of composite materials. To enhance the interfacial bonding, nanostructures are introduced into composite materials. Where the reinforcement structure is a metallic material, formation of nanopores on the metal surface can increase the bonding strength at the interface of the metal and polymer.

By way of example only, and not limitation, active carbon nanotubes with functional groups can be added into an epoxy resin. The modified epoxy resin containing active carbon nanotubes can then be introduced into the nanopores of an anodic aluminium oxide (AAO). The active functional groups help to form strong chemical bonding both between carbon nanotubes and epoxy, and between epoxy and AAO. Moreover, interface bonding is enhanced by the large specific area of the AAO, resulting in an improvement of the interface strength.

Multi-walled and single-walled carbon nanotubes can be used as additives in polymer materials to enhance the mechanical performance of the polymeric composite materials. Carbon nanotubes can be produced in relatively large quantities using metal catalysts and either ethylene or carbon monoxide as the carbon source. The structure of carbon nanotubes can be controlled through the catalyst and thermal conditions used in production.

By appropriate surface treatment, carbon nanotubes present a unique, active surface so that the carbon nanotube/polymer covalent bonding can be established. Surface treatment can be performed in nitric acid so that the surface of the tubes are rich in functional group of —COOH. The next step includes the reaction with thionyl chloride to convert the surface —COOH group to acid chloride functional groups. The carbon nanotubes containing acid chloride functionalities are very active to the amine cure agent for epoxy. The active carbon nanotubes can be mixed with epoxy and the curing agent, and secondary bonding type in the form of hydrogen bond between the AAO and the cross-linked epoxy and amine can be established. Therefore, the active carbon nanotubes are helpful to improve the interface bonding between the carbon nanotube and epoxy, and between the epoxy and AAO. As a result, the interface bonding is improved.

E. Adhesives and Helper Materials

In some versions of a strip, one or more components comprise an adhesive. Generally adhesive can be a mixture in a liquid or semi-liquid state that adheres or bonds items together. In some versions of a strip, adhesive is used to bond different components together as well as bonding components with jacket components and/or edge components. By way of example only, and not limitation, materials for adhesives can include: modified polyolefins with functional groups designed to bond to a variety of polyolefins, ionomers, polyamides, ethylene vinyl alcohol (EVOH), polyesters (PET), polycarbonates, polystyrenes, and metals such as steel and aluminum (e.g. Admer); UV curing adhesives (e.g. Norland); epoxies (e.g. Gorilla Epoxy, thiol-cured epoxy, amine-cured epoxy; epoxy-acrylate; epoxy-thiol/ene-thiol hybrid); polyurethanes; acrylonitrile-bases; among others. By way of further example only, and not limitation, optical and special application adhesives offered by Norland Products can be used in component (114).

Other materials for use with strip (100) can be helper materials, or materials that may not be the primary strength or traction generators, but may still serve valuable functions in terms of overall strip constructions and use, e.g. to enhance strip or component lifetime. Helper materials can be arranged in or between components of a strip. These helper materials can be filaments, yarn, fiber bundles, polymers, or other material types. For example, one type of helper material can be a lubricant material. In some versions a lubricant material is applied between components that satisfy the primary load carrying function and the safety function. This intermediate lubricant or anti-abrasive material can reduce wear on the components providing the safety function thereby preserving the load carrying ability of these safety function components.

By way of example only, and not limitation, some materials for these helper materials can include: fluoropolymers (e.g. Teflon); polytetrafluoroethylene (e.g. Gore); silicons; oil elastomers; natural and/or synthetic rubber; among others. In versions of strips including fluoropolymers, polymer matrix material coatings can comprise at least one member selected from tetrafluoroethylene polymers, trifluorochloroethylene copolymers, tetrafluoroethylene-hexafluoropropylene copolymers, tetrafluoroethylene-perfluoroalkylvinylether copolymers, tetrafluoroethylene, hexafluoropropylene-perfluoroalkylvinylether copolymers, vinylidene fluoride polymers, and ethylene-tetrafluoroethylene copolymers. In some other versions, polymer matrix material coatings comprise at least one member selected from the group consisting of trifluoroethylene polymers, tetrafluoroethylene polymers, and tetrafluoroethylenehexafluoropropylene copolymers.

V. Functional and Feature Considerations and Material Selection

When considering materials from a load carrying and/or safety function view, in some versions suitable materials provides lightweight relative to conventional steel cables, high longitudinal tensile strength, high stiffness, and bending fatigue resistance. When also considering the transmission function, suitable materials provide a sufficient coefficient of friction between a strip and a traction sheave. By way of example only, and not limitation, some example materials that can satisfy one or more of these functions include: epoxy resin; epoxy-thio system; eposy-thio/ene-thiol hybrid; epoxy polyacrylates; epoxy modified elastomer; thiol-cured epoxy-glass (e.g. E-glass or S-glass); woven fiberglass cloth reinforced with polyester, phenolics, thermoplastic polyester elastomer, nylon resin, vinyl ester; polyurethanes; silicon monocrystalline; silicon carbide; silicon rubber; carbon fiber; aramid fiber (e.g. Kevlar, Twaron, Nomex, Technora); reinforced thermoplastic polyester elastomer fibers (e.g. Hytrel); reinforced vinyl ester fibers; ultra-high molecular weight polyethylene fibers (e.g. Dyneema); liquid crystal polymer fibers (e.g. Vectran); poly(p-phenylene-2,6-benzobisoxazole) (PBO) (e.g. Zylon); basalt fiber; fiberglass; ceramic fibers; boron fibers; zirconia fibers; graphite fibers; tungsten fibers; quartz fibers; hybrid fibers (e.g. carbon/aramid, glass/aramid, carbon/glass); alumina/silica fibers; aluminum oxide fibers; steel fibers; among others.

When considering the feature of protecting, suitable materials will provide adequate protection of the components designed to provide the load carrying and/or safety functions. Protection can also be in terms of improvements in tensile strength, abrasion resistance, bending fatigue resistance, etc. By way of example only, and not limitation, some examples of materials that can satisfy this protection feature include: prepolymer (epoxy-acrylate adduct, vinyle ester, diene); polyurethane; epoxy-thiol system; epoxy-thiol/ene-thiol hybrid, exposy modified elastomer; silicon elastomer, silicon rubber, among others.

As mentioned above, some components of a strip can include micro-teeth or other surface enhancements. Materials suitable for micro-teeth and similar surface enhancements can be material with high stiffness that can be dispersed as small particles (e.g. powder) in the composite and/or in a coating material. In some versions micro-teeth can be formed as a separate component on the surface to act as a hook and loop fastener arrangement to fix components, to increase the efficiency of traction between a strip and a traction sheave, to control the displacement between components as well as between fiber and composite material. In special arrangements micro-teeth can repeatedly engage and disengage during use of the strip. By way of example only, and not limitation, materials for micro-teeth and other surface enhancement can include: alumina/silica; aluminum; copper; steel; iron; silver; quartz; silicon carbide, aluminum oxide (e.g. sapphire); boron; basalt; glass; ceramic; high-stiffness plastic; among others.

By way of example only, and not limitation, Table 24 and Table 25 show exemplary matrices of materials that can be used in versions of a strip to deliver certain functions or features for the strip. In Tables 24 and 25 the "X" indicates that the material can be used in providing the corresponding function or feature. Furthermore, blanks appearing in Tables 24 and 25 should not be construed to mean that a given material could not be used to provide the listed function or feature in some other versions.

TABLE 24

Exemplary Materials for Exemplary Functions/Features of a Strip

| | thiol-cured epoxy | Gorilla epoxy | thiol-ene/ thiol-epoxy hybrid | poly-urethane | aramid | Admer | basalt | steel | Vectran | Dyneema | thiol-cured epoxy-fiber | thiol-cured epoxy-carbon | thiol-cured epoxy-glass |
|---|---|---|---|---|---|---|---|---|---|---|---|---|---|
| Load Carrying | X | | X | | X | | X | X | X | | X | X | X |
| Protectant | | | X | X | | | | | X | X | | | |
| Safety | | | X | | X | | X | X | | | X | X | X |
| Transmission | | | | X | X | | X | | | | X | X | X |
| Binding | X | X | | X | | X | | | | | | | |
| Coating | X | | X | X | | | | | X | | | | |

TABLE 25

Exemplary Materials for Exemplary Functions/Features of a Strip

| Material Category | Material Type | Load Carrying | Protection and Transmission | Surface Enhancement | Binding | Lubricating |
|---|---|---|---|---|---|---|
| Elastomer (Resin) | Zytle | x | x | | | |
| | Hytrel | x | x | | | |
| | Vinylester | | x | | x | |
| | Polyurethane | x | x | | x | |
| | Epoxy-acrylate | x | x | | x | |
| | Epoxy-thiol system | x | x | | x | |
| | Epoxy-thiol/Ene-thiol hybrid | x | x | | x | |
| | Phenolics | x | x | | x | x |
| | Bismaleimides | | x | | | |
| | Polybutadien | | x | | | |
| Silicon | Silicon monocrystalline (m-Si) | x | x | | | |
| | Silicon carbide (SiC) | x | x | x | | |
| | silicon rubber | | x | | | x |
| | Lubricant oil | | | | | x |
| Special Materials | Teflon | | x | | | x |
| | Synthetic rubber | | x | | | x |
| | Gore | | | | | x |
| | Lubricant | | | | | x |
| Epoxy | Epoxy-acrylate | x | x | | x | |
| | Epoxy-thiol system | x | x | | x | |
| | Epoxy-thiol/Ene-thiol hybrid | x | x | | x | |
| | Novalac resin | x | x | | x | |
| | Epoxy terminated prepolymer | x | x | | x | |
| Fiber | Carbon | x | x | | | |
| | Aramid | x | x | | | |
| | Zylon | x | x | | | |
| | Fiberglass | x | x | | | |
| | Dyneema | x | x | | | |
| | Vectran | x | x | | | |
| | Ceramics | x | x | x | | |
| | Boron | x | x | x | | |
| | Zirconia | x | x | x | | |
| | Graphite | x | x | x | | |
| | Tungsten | x | x | x | | |
| | Hybrid (carbon/aramid, glass/aramid, carbon/glass) | x | x | | | |
| Powder | Glass | x | x | x | | |
| | Basalt | x | x | x | | |
| | Boron | x | x | x | | |
| | Alumina/silica | x | x | x | | |
| | $Al_2O_3$ | x | x | x | | |
| | Quartz | x | x | x | | |
| | Ceramic | x | x | x | | |
| | Copper | x | x | x | | |
| | High-stiffness plastic | x | x | x | | |
| | Steel (Iron) | x | x | x | | |
| Adhesive | Norland | | | | x | |
| | Epoxy Adhesive (Gorilla Epoxy, Thiol-cured epoxy, Epoxy-thiol/ene-thiol hybrid, Amine-cured epoxy) | x | x | | x | |
| | Epoxy-acrylate | x | x | | x | |
| | polyurethanes | x | x | | x | |
| | acrylonitrile-bases | x | x | | x | |
| | Admer | | | | x | |

VI. Exemplary Strips

Referring now to FIGS. 1-4, in one version, strip (100) comprises a single layer. In this version, strip (100) comprises a single component (114) that is comprised of carbon fiber and polyurethane composite. In the present example, the carbon fiber is continuous fiber oriented in the longitudinal direction of strip (100). The carbon fiber content of the composite is about 70% by volume, with a filament count of about 2000. The carbon content of the fibers is about 95%. The continuous fiber is unidirectional with a density of about 1.81 g/cc, a filament diameter of about 7.2 μm, and a thickness of about 1400 μm. The ultimate tensile strength of the fiber is about 4137 MPa and the tensile modulus is about 242 GPa. The electric resistivity of the fiber is about 0.00155 ohm-cm. The areal weight is about 1640 g/m$^2$. In the present example, the dimensions of strip (100) are about 20 mm in width and about 2 mm in thickness. Also in the present example, strip (100) has a breaking load that exceeds about 32 kN. Strip (100) in the present example can be used alone to provide the load, safety, and transmission functions discussed above. In other versions, two or more strips (100) of the present example are overlaid in a stacked arrangement, or spaced apart in a series arrangement to provide these functions.

Referring now to FIG. 10, in one version, strip (700) comprises component (704) surrounded by jacket component (702). In the present example, component (704) is comprised of four carbon fiber lamina and epoxy composite. The carbon fiber lamina comprises carbon fiber oriented in the longitudinal direction of strip (700). The continuous lamina is sized by epoxy. The sizing content is about 1% by weight. The carbon content is greater than about 95% by weight. The volume resistivity of the tow is about 0.00160 ohm-cm. The tensile strength of the tow at break is about 3600 MPa. The elongation at break is about 1.5%, and the modulus of elasticity is about 240 GPa. The filament diameter is about 7 μm. The density of the tow is about 1.80 g/cc. The carbon fiber content of strip (700) is about 70% by volume.

In the present example of FIG. 10, jacket component (702) is comprised of thermoplastic polyurethane. The polyurethane is of extrusion grade, and has a Shore A hardness of about 80. The tensile strength at break is about 24.52 MPa. The elongation at break is about 950%. The 100% modulus is about 0.00490 GPa. The 300% modulus is about 0.0078 GPa. The resilience is 40, and the abrasion is less than about 35 $mm^3$.

In the present example of FIG. 10, the dimensions of strip (700) are about 30 mm in width and about 3 mm in thickness. Also in the present example, strip (700) has a breaking load that exceeds about 32 kN. Strip (700) in the present example can be used alone to provide the load, safety, and transmission functions discussed above. In other versions, two or more strips (700) of the present example are overlaid in a stacked arrangement, or spaced apart in a series arrangement to provide these functions.

Figure 20:
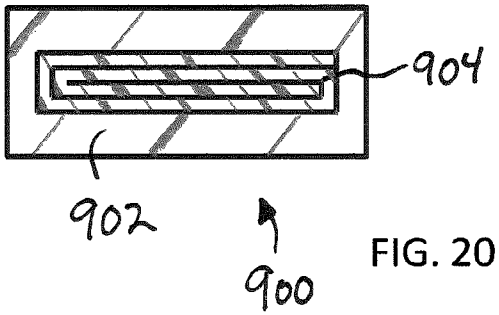
FIG. 20 depicts a section view taken from the longitudinal direction in another version of a strip similar to the strip of FIG. 1, where the strip comprises multiple layers created by one or more longitudinal folds that are surrounded by a jacket component, where the folds are wound around one another.

Referring now to FIG. 12, in one version, strip (900) comprises component (904) that is longitudinally folded and surrounded by jacket component (902). In the present example, folded component (904) is comprised of a carbon fiber and thiol-epoxy-ene ternary composite. The carbon fiber is oriented in the longitudinal direction of strip (900) and the carbon fiber content of the composite is about 50% by weight. In the present example, jacket component (902) is comprised of polyurethane. As shown in FIG. 12, component (904) is folded longitudinally in a back and forth fashion creating a layering effect. As shown in FIG. 20, in another version component (904) can be folded longitudinally around itself to create a layering effect. In the present example of FIG. 12, there are 4 plies of lamina bonded for form component (904). The dimensions of strip (900) are about 20 mm in width and about 3 mm in thickness. The breaking load of strip (900) exceeds about 45 kN. Strip (900) in the present examples shown in FIGS. 12 and 20 can be used alone to provide the load, safety, and transmission functions discussed above. In other versions, two or more strips (900) of the present examples are overlaid in a stacked arrangement, or spaced apart in a series arrangement to provide these functions.

Figure 21:
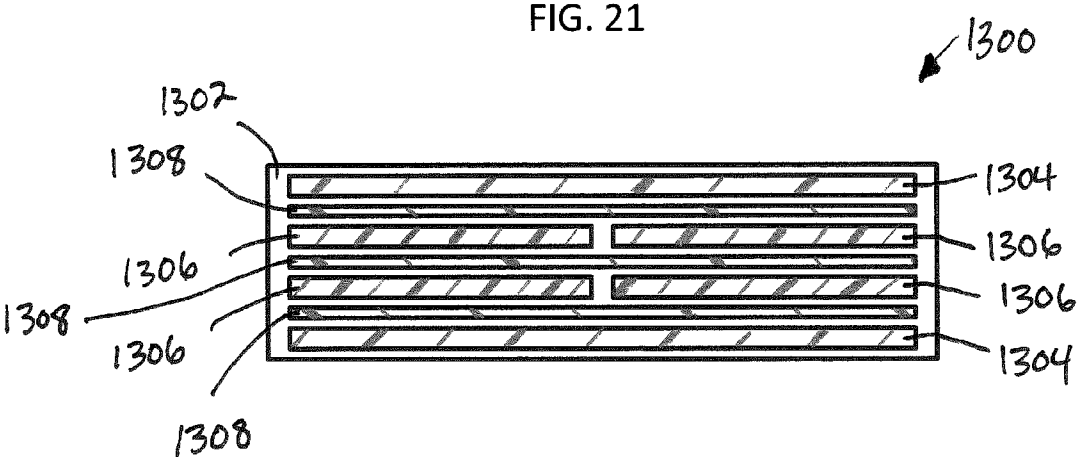
FIG. 21 depicts a section view taken from the longitudinal direction in another version of a strip similar to the strip of FIG. 1, where the strip comprises multiple layers and multiple components, including a jacket component.

Referring now to FIG. 21, in one version, strip (1300) comprises multiple layers having an outer jacket component (1302) comprised of epoxy. In some versions, outer jacket component (1302) incorporates micro-teeth features dispersed throughout component (1302). Components (1304) of strip (1300) in the present example are comprised of aramid fiber and epoxy composite. Components (1306) in the present example are comprised of carbon fiber and epoxy composite. Between each fiber-epoxy composite layer is component (1308) that comprises adhesive. In the present example, the fiber contents in the composites can range from about 50% to about 70%. Also, the aramid fiber and carbon fiber are oriented in the longitudinal direction of strip (1300). In the present example, the dimensions of strip (1300) are about 20 mm in width and about 3 mm in thickness. The breaking load of strip (1300) exceeds about 45 kN. Strip (1300) in the present example can be used alone to provide the load, safety, and transmission functions discussed above. In other versions, two or more strips (1300) of the present example can be overlaid in a stacked arrangement, or spaced apart in a series arrangement to provide these functions.

Figure 22:
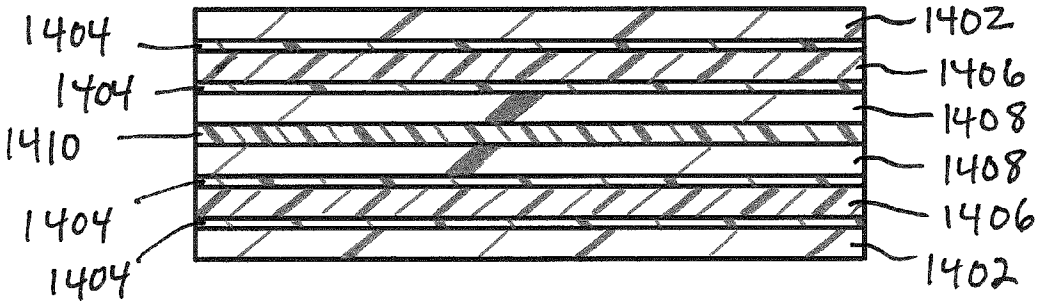
FIG. 22 depicts a section view taken from the longitudinal direction in another version of a strip similar to the strip of FIG. 1, where the strip comprises multiple layers and multiple components without a jacket component.

Referring now to FIG. 22, in one version, strip (1400) comprises multiple layers having components (1402, 1404, 1406, 1408, 1410). Components (1402) of strip (1400) in the present example are comprised of thermoplastic epoxy. Components (1404) of strip (1400) in the present example are comprised of adhesive. Components (1406) of strip (1400) in the present example are comprised of glass fiber and polyurethane composite. Components (1408) of strip (1400) in the present example are comprised of carbon fiber and polyurethane composite. Component (1410) of strip (1400) in the present example is an information transfer layer as will be described in greater detail below. Strip (1400) in the present example can be used alone to provide the load, safety, and transmission functions discussed above. By way of example, and not limitation, in the present example when strip (1400) is used alone, component (1402) provides the transmission function, components (1406, 1408) combine to provide the load and safety functions, and components (1404) provides the binding feature holding the various components together. In other versions, two or more strips (1400) of the present example can be overlaid in a stacked arrangement, or spaced apart in a series arrangement to provide these functions.

Figure 23:
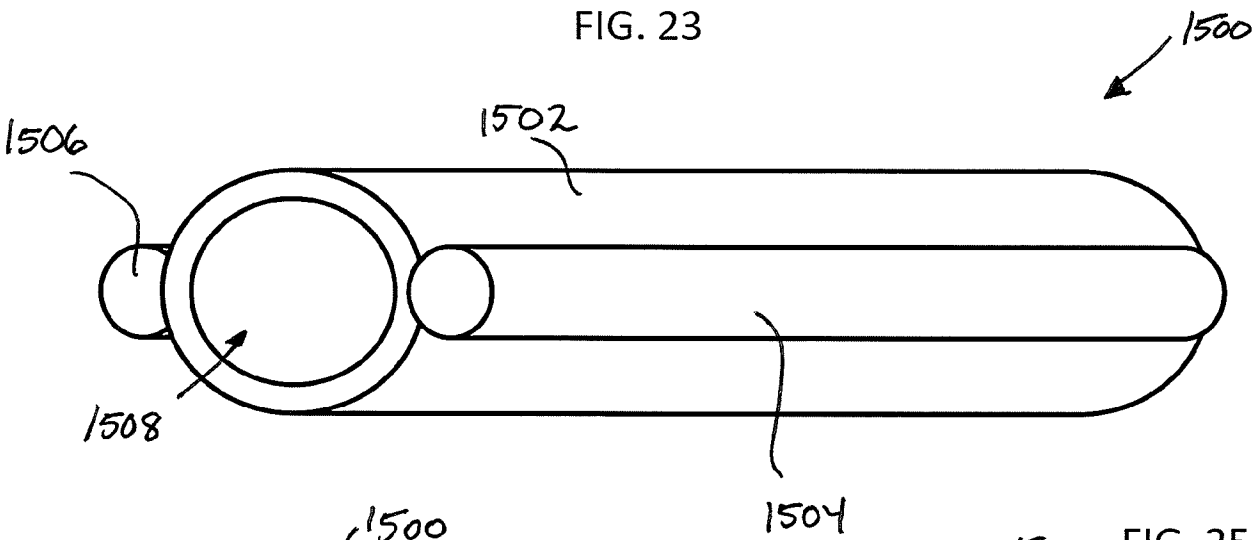
FIG. 23 depicts a perspective view of another exemplary strip for use with an elevator.
Figure 25:
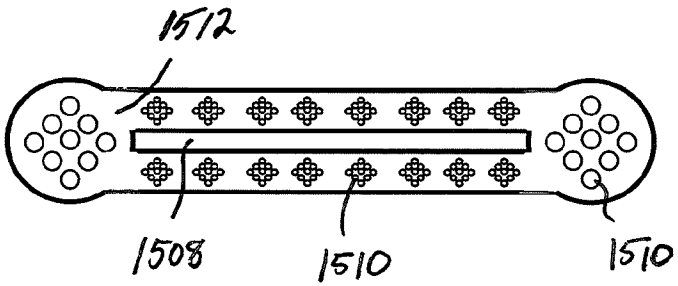
FIGS. 24 and 25 depict section views of the strip of FIG. 23 taken from the longitudinal direction, where the strip is not under tension and/or compression as shown in FIG. 24, but is under tension and/or compression as shown in FIG. 25.
Figure 24:
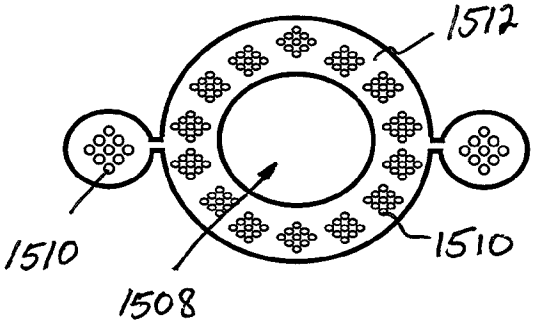
Figure 26:
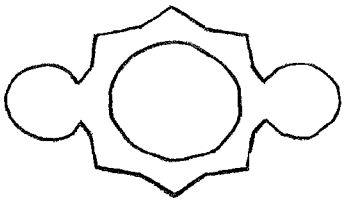
FIGS. 26-31 depict end views taken from the longitudinal direction in other versions of strips similar to the strip of FIG. 23.
Figure 27:
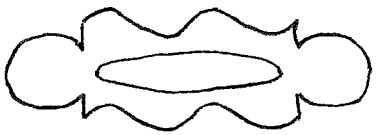

Referring now to FIGS. 23-35, in another version, an exemplary strip is configured as a hose-like structure. FIGS. 23-25 illustrate one version of a strip (1500), where strip (1500) comprises a body (1502), a first cord (1504), and a second cord (1506). First and second cords (1504, 1506) are connected with body (1502) by extensions (1510). Body (1502) is shaped as an elongated cylinder that includes hollow interior (1508) extending the length of body (1502). As shown in FIG. 24, strip (1500) is comprised of fiber (1510) and a matrix material (1512). Fiber (1510) can include any of the fiber materials mentioned previously. In the illustrated version in FIGS. 23-25, fiber (1510) is carbon fiber. Matrix material (1512) can include any of the matrix materials mentioned previously. In the illustrated version in FIGS. 23-25, matrix material (1512) is an epoxy. As also shown in the illustrated version, fiber (1510) is oriented in the longitudinal direction, which runs parallel with the length of body (1502). In other versions, fiber (1510) can be oriented in other directions instead of the longitudinal direction or in addition to the longitudinal direction.

When in use, strip (1500) converts to a flat configuration by compressing body (1502), which evacuates hollow interior (1508) as shown in FIG. 25. When flat, strip (1500) resembles a multiple layer strip configuration. The compression of body (1502) is caused by tensioning forces when in use with an elevator system. The tension applied to strip (1500) will cause interior hollow space (1508) to evacuate, at least to some degree, which caused strip (1500) to assume the flat configuration. Also, strip (1500) will flatten when strip (1500) runs over a roller or traction sheave, which creates a compression force applied to strip (1500).

The design of strip (1500) can be such that the evacuation of interior hollow space (1508) can be controlled or setup for particular applications. For instance, in some versions, interior hollow space (1508) can be completely evacuated when strip (1500) is in use. In other versions, interior hollow space (1508) can be only partially evacuated when strip (1500) is in use. In applications where there is some remaining interior hollow space (1508) when in use, this space can provide a passageway for other materials or structures. By way of example only, and not limitation, remaining interior hollow space (1508) may allow for certain strip testing and diagnostic tools to be inserted for testing and/or detecting strip condition. For example, a fiber-optic camera for visual assessment of the strip could be posited within remaining interior hollow space (1508). Also by way of example, inert, non-corrosive gas or special fluid can be pumped inside remaining interior hollow space (1508). Such pumped in gas could act as a lubricant between touched surfaces, inhibit corrosion by replacing the air that could cause corrosion to any metallic fibers or other members inserted therein, and/or aid in generating a pressure that gives information about the strip condition. Other information or uses when incorporating other tools/members inside remaining interior hollow space (1508) can include: detecting imperfectly tensioned strips (e.g. with a magnetic traction sheave); detecting the efficiency of each component (e.g. by incorporating different patterns of detectable components for different components); measuring the speed of the strip (can be used as speed control e.g. governor); detecting slippage; measuring elongation; detecting smoke, heat, or fire; measuring position for use with position measurement systems; transmitting information from the strip or to the strip; measuring or detecting abnormal operational or environmental effects (e.g. moisture levels, temperature, humidity, derailing of the strip, strip weave, blocked bearings, cuts on the strip, increasing friction rates, grinding of the strip oil contamination, biodegradation); detecting temperature differences at different floors in high towers; detecting lightening; detecting building shaking/sway/earthquakes; detecting noise and frequency changes; incorporating a contactless power supply and/or inductive transformer; among others.

Figure 28:
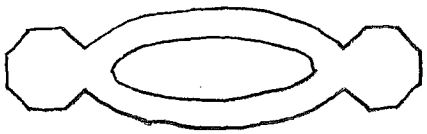
Figure 29:
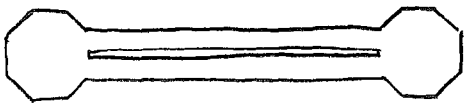
Figure 30:
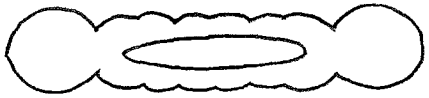
Figure 31:
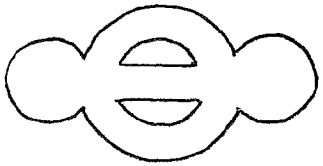

While FIGS. 23-25 show strip (1500) with first and second cords (1504, 1506), in other versions cords (1504, 1506) are omitted. First and second cords (1504, 1506), in the present example, have a cylindrical shape, with a circular cross-section. In other versions, first and second cords (1504, 1506) have other shapes. For example, as shown in FIGS. 28 and 29, cords can have octagonal cross-sections. Still yet other shapes for first and second cords (1504, 1506) will be apparent to those of ordinary skill in the art based on the teachings herein. Furthermore, side cords (1504, 1506) can be comprised from the same materials as body (1502), or from different materials. For example, in one version, side cords (1504, 1506) provide transmission function to strip (1500) and are made with fiber reinforced thermoplastic polyurethane while body (1502) is made with fiber reinforced epoxy.

Strip (1500) can be made using one or more processes that include molding. Introducing matrix material (1512) could be by injection in one example. Fiber (1510) could be also introduced to the mold by extrusion in one example. After the matrix material is fully cured, strip (1500) is released from the mold to provide the completed configuration. The mold used to make strip (1500) could be designed in different shapes to form strips with different configurations as well as different thicknesses. By way of example only, and not limitation, FIGS. 26-31 show longitudinal sectional views of some exemplary configurations. In some of these and other versions, the outer surface of body (1502) is molded such that coefficient of friction of the strip is increased to aid in the transmission function. This can be accomplished by the mold having a non-smooth interior such that the outer surface of body (1502) is rough or has some texture other than smooth.

Figure 32:
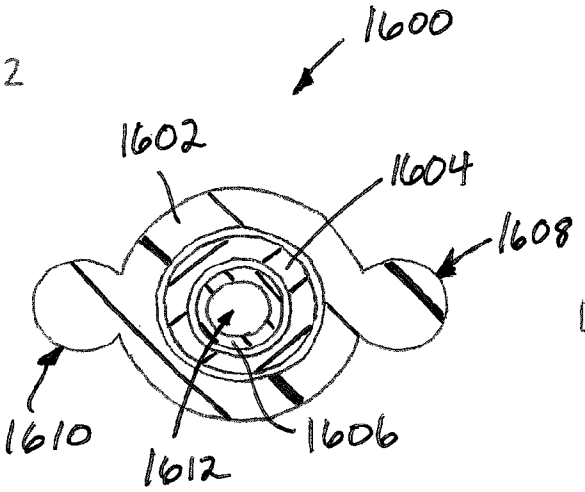
FIGS. 32 and 33 depict section views taken from the longitudinal direction in another version of a strip similar to the strip of FIG. 23, where the strip includes multiple hose-like components positioned one inside the other, where the strip is shown not under tension or compression in FIG. 32, and the strip is shown under tension and/or compression in FIG. 33.
Figure 33:
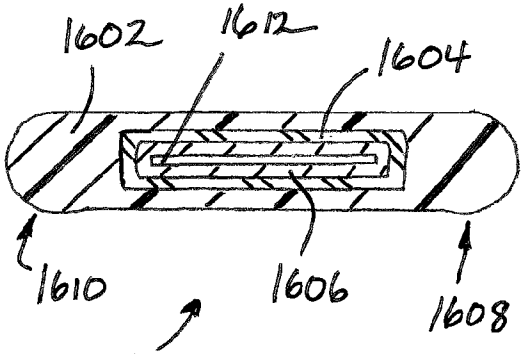

FIGS. 32 and 33 illustrate strip (1600), which resembles another version of a hose-like strip that includes multiple hose-like strips (1602, 1604, 1606) positioned one inside the other. As shown in FIG. 32, when strip (1600) is not sufficiently tensioned, strip (1600) has an elongated cylindrical shape. As shown in FIG. 33, when strip (1600) is under sufficient tension, strip (1600) flattens thus giving strip (1600) a flat strip shape.

In versions that use multiple hose-like strips, the combined strip can be configured having any number of hose-like strips positioned one inside the other creating layers. In such examples as shown in FIGS. 32 and 33, the load can be distributed over more than one layer. In some versions of strip (1600), adhesive materials are not required to keep components together. In some versions, outer strip (1602) is made of material that can provide good traction coefficient and wear resistance. In some versions, outer strip (1602) could be used as a cover for another strip design, e.g. as jacket component as described above with respect to other strips. In some versions, strip (1600) can be surrounded by twisted ribbons of nonmetallic or metallic materials that can provide extra strength to strip (1600). In some versions wire rope, fiber core, round synthetic rope, and/or ribbons could be inserted inside interior hollow space (1612) of strip (1600).

Figure 34:
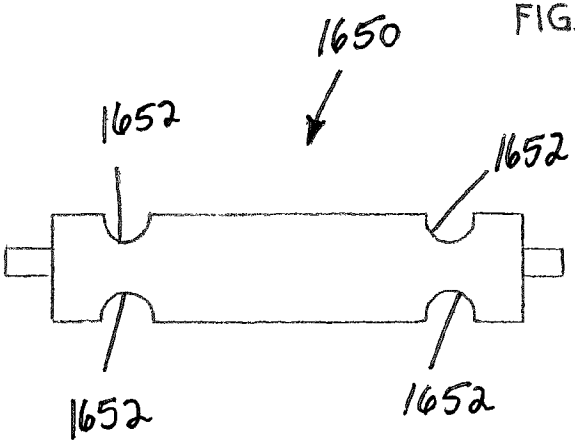
FIG. 34 depicts a front view of an exemplary traction sheave for use with the strip of FIGS. 32 and 33, where the traction sheave comprises grooves.
Figure 35:
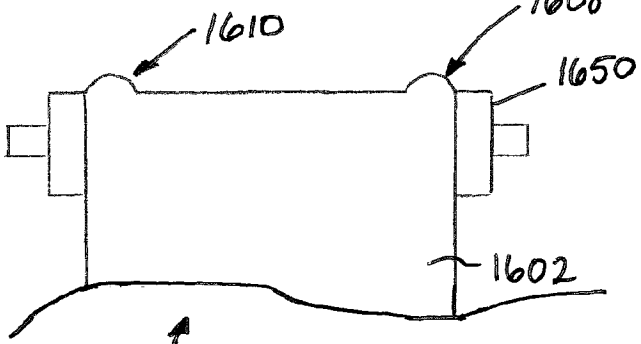
FIG. 35 depicts a front view of the strip of FIGS. 32 and 33 combined with the traction sheave of FIG. 34.

Referring to FIGS. 34 and 35, according to the surface configuration of strip (1600), the profile of the surface of a traction sheave (1650) is designed to provide track and guidance to strip (1600). As shown in FIGS. 32 and 33, strip (1600) includes first and second cords (1608, 1610) that protrude slightly from the overall compressed width of strip (1600). The surface of traction sheave (1650) include grooves (1652) that are configured to engage with first and second cords (1608, 1610). This engagement provides track and guidance to strip (1600). While the present example shows and describes first and second cords (1608, 1610) and grooves (1652) as cylindrical and half-cylindrical shapes respectively, in other versions of strips and traction sheaves other shapes for first and second cords and traction sheave grooves can be used.

Figure 36:
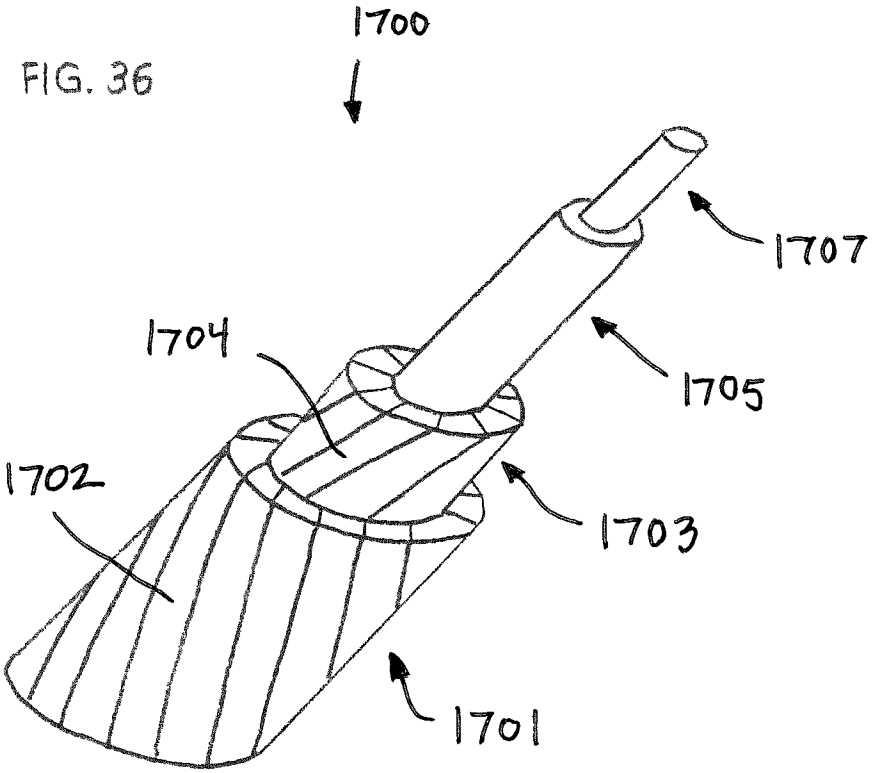
FIG. 36 depicts a perspective view in partial cut-away of another exemplary strip, where the strip comprises twisted strips around a core component.

Referring to FIG. 36, another version of a strip (1700) is shown where strip (1700) can be used as an elevator suspension and transmission structure. In the present example, strip (1700) is comprised of composite bands or strips that are twisted around at least one core. Various twist patterns can be used when constructing strip (1700). As shown in FIG. 36, strip (1700) comprises a first load carrying layer (1701) comprised of a plurality of composite bands (1702) that are twisted around a second load carrying layer (1703). Second load carrying layer (1703) is comprised of composite bands (1704) that are twisted around a helper layer (1705). Helper layer (1705) is positioned around a core (1707). In the present example, first load carrying layer (1701) also functions as a transmission layer. Composite bands (1702) in the present example comprise aramid fiber and epoxy composite. Composite bands (1704) of second load carrying layer (1703) comprise carbon fiber and epoxy composite. Helper layer (1705) is comprised of a lubricating material, such as polytetrafluoroethylene. Core (1707) in the present example is comprised of boron-carbon fiber composite, i.e. Hy-Bor fiber. While FIG. 36 shows, by way of example only, a complete strip design, in other versions, this twisted strip technique can be applied to any of the other individual components or combination of components that comprise other strip designs described herein or otherwise.

Several exemplary strips and components thereof have been shown and described above. Furthermore numerous materials of construction have been described. Based on this information, a number of strip designs are possible, where the strips can be single layer, multiple layer, single component, multiple component, arranged in a stacked configuration, arranged in a series configuration, and where the various components—including jacket and edge components—can be constructed from the various materials described. Again, the exemplary strips shown and described in the drawings are not intended to be limiting, but instead represent some of the possible strip designs suitable for use in an elevator system.

VII. Strip Monitoring

As a result of impact and fatigue in the exemplary strips, deterioration can occur that can be difficult to inspect visually. Examples of deterioration can include: loss of breaking strength, cracks, cuts, discontinuation of load bearing member, among others. Using strips, as described above, provides for use of techniques that can detect deterioration or abnormalities in exemplary strips. Such techniques comprise detecting changes in the physical and/or chemical properties of the strip due to abrasion and wear in the load carrying components, for example. Detection of such deterioration can be used to trigger automatic safety responses.

In terms of deterioration caused by chemical changes that take place on the molecular level, the following can indicate that a chemical change took place: change of odor; change of color; change in temperature or energy, such as the production (exothermic) or loss (endothermic) of heat; change of form; emission of light, heat, or sound; formation of gases; decomposition of organic matter; among others. Furthermore, chemical changes can impact physical changes in exemplary strips. In terms of deterioration caused by physical changes, the following can indicate that a physical change took place: observation of changes in physical properties like color, size, luster, or smell. In general, it may be beneficial to provide a permanent physical effect in the strip that changes with the breaking strength loss or other measured condition of the strip.

By way of example only, and not limitation, fluorescence, which is the emission of light by a substance that has absorbed light or other electromagnetic radiation of a different wavelength, is one of the techniques that could be used to detect deterioration in a strip. In most cases, fluorescence occurs when an orbital electron of a molecule, atom, or nanostructure relaxes to its ground state by emitting a photon of light after being excited to a higher quantum state by some type of energy. By irradiating a strip with electromagnetic radiation, it is possible for one electron to absorb photons that can lead to emission of radiation having a specific wavelength that can provide information about the strip condition. In some versions, materials that can produce fluorescence as a result of electromagnetic radiation effect can be incorporated in the coating or helper material. Microwaves, infrared, x-rays, or other radiations can be used for detection or activation purposes.

In another exemplary technique, color change that occurs due to incorporation of, for example, temperature or gas sensitive materials in the matrix of the strip could be used. The color of temperature sensitive material may change permanently when the temperature of the strip is increased due to the failure of, e.g. the load bearing member, or high abrasion generated between strip components.

In another exemplary technique, the long fiber or load bearing members of a strip can be labeled with electromagnetic responsive materials that can be used for detecting elongation, tension, or elevator loads. In this technique, the labeling of fiber at equal distances with the electromagnetic responsive materials allows measuring elongation change in the fiber or load bearing member. For example, in one version illuminated stickers or bands are placed on the outer surface of the strip at equal distances and when light is flashed upon these stickers, they shine such that it is easy to track and detect any change in elongation. This technique can also allow measuring the speed of the strip and, by comparing the strip speed with the sheave speed, the rate of strip slippage over the sheave can be detected.

In another exemplary technique, an emitted gas can be detected to indicate strip deterioration. For example, a material that emits gas in response to thermal dissociation can be incorporated in the strip components. As a result of a heat increase, for example, or environmental condition changes in the strip, this material will dissociate producing a detectable gas. Using an appropriate gas detector, the strip condition can then be tracked.

Still in another exemplary technique, computer readable optical patterns can be used to detect changes in the strip.

By way of further example, one such technique uses an exemplary strip that incorporates magnetic particles, e.g. nano-magnetic particles. By using magnetic particles, a magnetic field exciter, an array of magnetic flux sensors, and a data analyzer, it is possible to detect the magnetic flux leakage (related to the density) which is indicative of a defect or deterioration in a strip. The magnetic flux leakage occurs because the defect will result in penetration of the magnetic flux to the air. Comparing the obtained flux leakage data with the pre-stored data provides accurate information about the strip condition. Therefore, defects such as a crack, cut, or other discontinuity in the components of the strip can be detected by monitoring magnetic flux density distribution.

In one example where the strip incorporates magnetic particles, the load carrying component includes high homogeneously dispersed nano-magnetic particles for detecting defects within the strip. In other examples the distribution of magnetic particles can be different, e.g. in linear or nonlinear patterns/spots. Also, the magnetic spots could be in different orientations from one layer to another. Moreover, the average distance between the distributed patterns could be different from one layer to another. The method of detection can be provided by running the strip inside a box equipped with sensors that are connected to the data analyzer. When a magnetic field is applied to the strip containing the load carrying component with high homogeneously dispersed nano-magnetic particles, a continuous magnetic flux will be generated. Consequently, a uniformed profile will be plotted by a data analyzer of the system. If any cracks/defects occurred in the load carrying component, magnetic flux leakage will be produced and non-uniformity will appear on the profile plotted by a data analyzer.

Many functions could be provided by the above described techniques, such as: detecting imperfectly tensioned strips (e.g. with a magnetic traction sheave); detecting the efficiency of each component (e.g. by incorporating different patterns of detectable components for different components); measuring the speed of the strip (can be used as speed control, e.g. governor); detecting slippage; measuring elongation; detecting smoke, heat, or fire; measuring position for use with position measurement systems; transmitting information from the strip or to the strip; measuring or detecting abnormal operational or environmental effects (e.g. moisture levels, temperature, humidity, derailing of the strip, strip weave, blocked bearings, cuts on the strip, increasing friction rates, grinding of the strip oil contamination, biodegradation); detecting temperature differences at different floors in high towers; detecting lightening; detecting building shaking/sway/earthquakes; detecting noise and frequency changes; incorporating a contactless power supply and/or inductive transformer; among others.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An elevator suspension and transmission strip, wherein the strip comprises:

a. a first transmission layer on the outside of the strip configured to contact a traction sheave, wherein the transmission layer is comprised of a polymer;

b. a first load carrying layer and a second load carrying layer comprised of a fiber reinforced composite material and configured to support the weight of the elevator, wherein both the first and second load carrying layers are entirely enclosed by the first transmission layer, with the first and second load carrying layers positioned one above the other relative to the thickness of the strip;

c. an information transfer layer positioned between the first load carrying layer and the second load carrying layer, wherein the information transfer layer is not a load carrying layer, wherein the information transfer layer comprises a detectable material separate from the fiber reinforced composite material of the first and second load carrying layers, wherein the detectable material provides information on the condition of the strip; and d. multiple adhesive layers configured to bind the first transmission layer, the first load carrying layer, the second load carrying layer, and the information transfer layer together such that the strip forms a unitary structure.

2. The strip of claim 1, wherein the information transfer layer comprises magnetic particles, configured to permit detection of magnetic flux.

3. The strip of claim 1 further comprising a safety layer configured to provide redundant support for the weight of the elevator.

4. The strip of claim 3, wherein the first load carrying layer is comprised of a first fiber reinforced composite material, wherein the second load carrying layer is comprised of a second fiber reinforced composite material.

5. The strip of claim 4, wherein the first fiber reinforced composite material is carbon fiber and polyurethane composite, and wherein the second fiber reinforced composite material is glass fiber and polyurethane composite.

6. The strip of claim 1, wherein the detectable material is capable of producing fluorescence.

7. The strip of claim 1, wherein the detectable material comprises an electromagnetic responsive label.

8. The strip of claim 1, wherein the detectable material is capable of emitting a detectable gas.

9. The strip of claim 1, wherein the detectable material comprises nano-magnetic particles.

* * * * *